US012389980B2

(12) United States Patent
Vasut

(10) Patent No.: US 12,389,980 B2
(45) Date of Patent: Aug. 19, 2025

(54) INTERCHANGEABLE BOOT ATTACHMENT

(71) Applicant: Cora Vasut, Ottawa (CA)

(72) Inventor: Cora Vasut, Ottawa (CA)

(73) Assignee: Cora Vasut, Kanata (CA)

( * ) Notice: Subject to any disclaimer, the term of this patent is extended or adjusted under 35 U.S.C. 154(b) by 315 days.

(21) Appl. No.: 18/303,978

(22) Filed: Apr. 20, 2023

(65) Prior Publication Data

US 2024/0349844 A1 Oct. 24, 2024

(51) Int. Cl.
*A43B 5/04* (2006.01)
*A43B 5/00* (2022.01)
*A63C 1/00* (2006.01)

(52) U.S. Cl.
CPC ..... *A43B 5/0401* (2013.01); *A43B 5/002* (2013.01); *A63C 1/00* (2013.01)

(58) Field of Classification Search
CPC ..... A63C 17/18; A63C 1/303; A63C 1/04; A63C 1/18; A63C 1/00; A43B 5/1633; A43B 3/24; A43B 5/0401; A43B 5/002
See application file for complete search history.

(56) References Cited

U.S. PATENT DOCUMENTS 2,095,942 A * 10/1937 Wetterstrand ..... A63C 17/18 280/841
2,874,970 A * 2/1959 Mall ..... A63C 17/18 280/11.12
4,150,499 A * 4/1979 Wang ..... A43B 5/1633 280/841
4,932,675 A * 6/1990 Olson ..... A63C 1/22 280/11.208
6,120,038 A * 9/2000 Dong ..... A43B 5/1633 280/11.33
6,145,852 A * 11/2000 Bain ..... A63C 17/061 280/11.221
10,220,294 B1 * 3/2019 Pierre-Louis ..... A63C 17/0093
2020/0368602 A1 * 11/2020 Bollis ..... A63C 3/04
2023/0000201 A1 * 1/2023 Brannon ..... A43B 3/24

* cited by examiner

*Primary Examiner* — Brian L Swenson

(74) *Attorney, Agent, or Firm* — Stratford Group Ltd.

(57) ABSTRACT

An interchangeable boot attachment is provided. An interchangeable boot attachment comprising a buckle strap affixed to a baseplate around a heel of the baseplate and an insert. The baseplate having an insert channel along a bottom of the baseplate that tapers from an opening at the heel towards a toe end of the baseplate. The insert having a tapered projection that tapers in an identical formation to the insert channel and is coupled to the insert channel during assembly such that a dovetail joint is formed between the opening, the insert channel and the tapered projection. The opening providing access to the insert channel for the insert. The buckle rotated and snapped to apply tension along the strap to secure the insert. The buckle decoupled and released from the strap to remove the strap from the opening to allow for removing the insert.

11 Claims, 14 Drawing Sheets

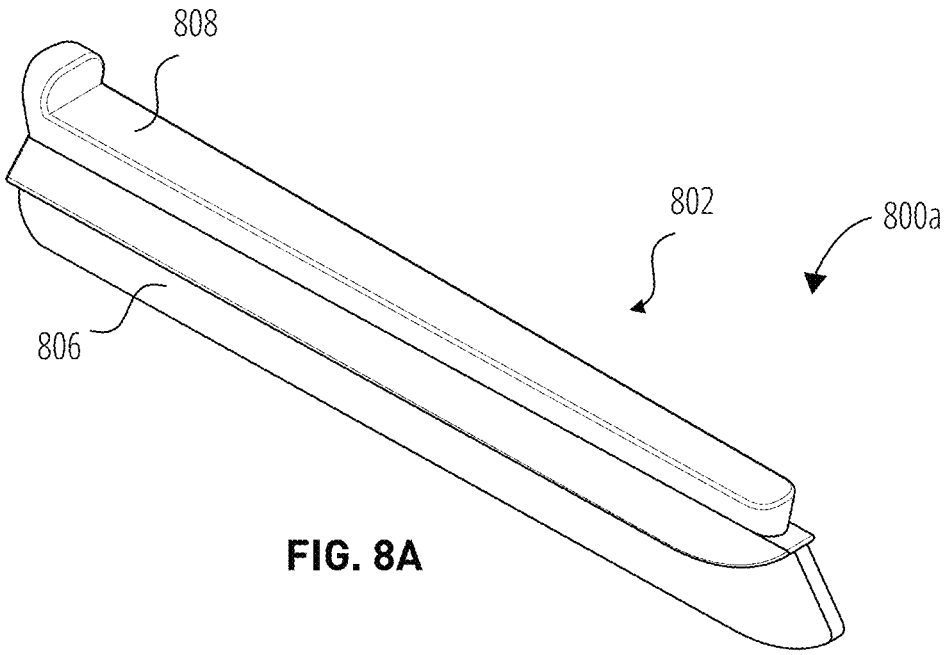
FIG. 8A
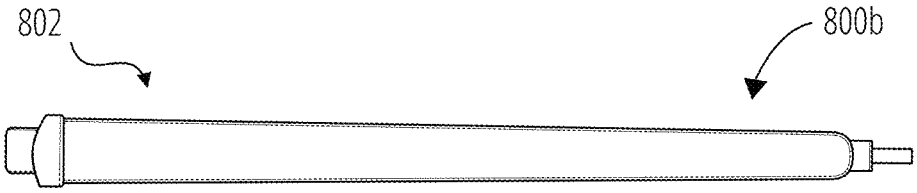
FIG. 8B
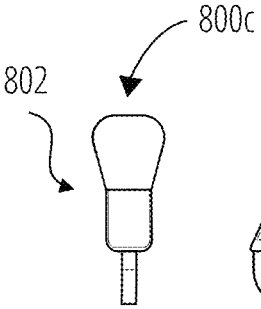
FIG. 8C
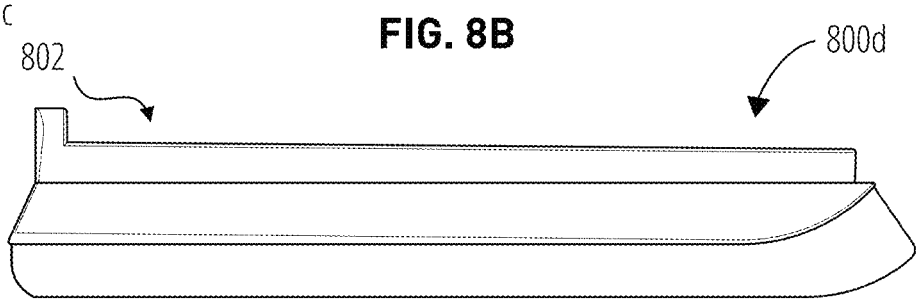
FIG. 8D
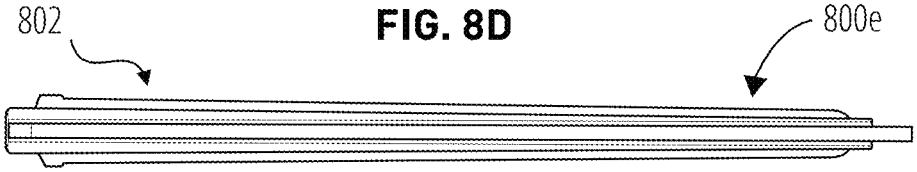
FIG. 8E
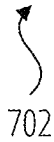

INTERCHANGEABLE BOOT ATTACHMENT

FIELD OF THE INVENTION

The present disclosure relates to an interchangeable boot attachment, more specifically, but not by way of limitation, more particularly to an interchangeable boot attachment for allowing seamless transition between a variety of boot modes through the exchange of a plurality of inserts that is assembled intuitively and performs in a secure manner.

BACKGROUND

Any discussion of the related art throughout the specification should in no way be considered as an admission that such related art is widely known or forms part of common general knowledge in the field.

U.S. Pub. No. 2015/0321074 A1 (Barbera et al.) discloses a chassis having a motive interface device affixed thereto for a motive sport footwear, wherein the chassis has a housing of rigid plastic or rubber, a mechanism for attachment of a motive interface device at a bottom portion of the chassis, and a top portion of the chassis having at least two through holes therein each having an internally threaded metal insert. Shortcomings include an inability to safely and securely affix the one or more inserts onto an existing boot in a seamless, time efficient manner.

D.E. Pat. No. 29,608,296 U1 (Schaeffer) discloses a shoe with a detachable lower part, designed as a lower part for an ice skate, roller skate, inline skate, sliding shoe, roller skate or the like. Shortcomings include an inability to allow for a smooth and efficient transition between the walking mode and the skate mode, an inability to safely and securely affix the one or more inserts via a quick release buckle onto an existing boot with minimal component exchange that can be accomplished in a seamless, time efficient manner and inability to prevent accidental release of the detachable lower part.

E.P. Pat. No. 891,792 B1 (Nicoletti et al.) discloses ice skates which have blades arranged for fixing releasably to the body of the skate so that the user can change the blade without having to replace the body of the skate or the associated boot are known. The skates generally only permitting interchangeable replacement of blades of identical configuration and the user is consequently forced to equip himself with a different pair of skates for each of the skating disciplines which he intends to practice such as, for example, ice hockey, for which short, thick blades are required, or speed skating for which, on the other hand, relatively long, thin blades are required. Shortcomings include an inability to allow for a smooth and efficient transition between the walking mode and the skate mode, an inability to safely and securely affix the one or more inserts via a quick release buckle onto an existing boot with minimal component exchange that can be accomplished in a seamless, time efficient manner and an inability to attach a member for hiking, rollerblading or roller skating.

E.P. Pat. No. 3,354,149 B1 (Navarro et al.) discloses a footwear item skate with multiple interchangeable blades for ice and skating rinks, designed to allow a person to slide on a flat, sliding surface, with the footwear item-skate based on a functional structure with interchangeable metal blades, comprising a boot, which has the advantages of sports footwear items in regards to its comfort and flexibility, and providing very good stability thanks to its multiple metal blades arranged in parallel and at a minimum distance from the ground. Shortcomings include an inability to allow for a smooth and efficient transition between the walking mode and the skate mode, an inability to safely and securely affix the one or more inserts via a quick release buckle onto an existing boot with minimal component exchange that can be accomplished in a seamless, time efficient manner, an inability to attach a member for hiking, rollerblading or roller skating, an inability to prevent accidental release of the skate and an inability to be compatible with different blade forms that are more appropriate for different types of skating.

U.S. Pat. No. 1,991,855 A (Johnson) discloses an interchangeable skate and shoe that has an offset stud rotatively engaged in a bayonet opening in the shoe bottom for the engagement and disengagement of these parts, and in addition, the skate has a slide support and a catch for coaction with other portions of the shoe for firmly holding the skate in position on the shoe. Shortcomings include an inability to allow for a smooth and efficient transition between the walking mode and the skate mode and an inability to safely and securely affix the one or more inserts via a quick release buckle onto an existing boot with minimal component exchange that can be accomplished in a seamless, time efficient manner.

U.S. Pat. No. 3,026,118 A (Pare) discloses shoe skates wherein the skate is detachable from the shoe. Shortcomings include an inability to allow for a smooth and efficient transition between the walking mode and the skate mode and an inability to safely and securely affix the one or more inserts via a quick release buckle onto an existing boot with minimal component exchange that can be accomplished in a seamless, time efficient manner.

U.S. Pat. No. 4,008,901 A (Conn) discloses an improved method of securing and/or fastening the two designs of skates; the ice skate and the wheel type roller skate into one shoe attachment design and invention so as to use the one pair of skating shoes for the dual skating purpose. The skates thus being manufactured or constructed with the attachments so as to be connected to the one pair of skating shoes, thus one pair of skating shoes to be used for both types of skating wherein the street shoe sole attachment can be connected to said shoe so as to use as the common street shoe, thus the triple skates attachments. Shortcomings include an inability to allow for a smooth and efficient transition between the walking mode and the skate mode and an inability to safely and securely affix the one or more inserts via a quick release buckle onto an existing boot with minimal component exchange that can be accomplished in a seamless, time efficient manner.

U.S. Pat. No. 4,150,499 A (Wang) discloses a shoe adapted for use with a plurality of various attachable and interchangeable skating accessories whereby the accessories may be selectively and removably locked into the sole of the shoe, and whereby certain safety features are provided in the form of front and rear stops for a roller skate. Shortcomings include an inability to allow for a smooth and efficient transition between the walking mode and the skate mode and an inability to safely and securely affix the one or more inserts via a quick release buckle onto an existing boot with minimal component exchange that can be accomplished in a seamless, time efficient manner.

U.S. Pat. No. 5,961,129 A (Post et al.) discloses a quick-release interlocking frame assembly for interchangeably mounting at separate times operative sports devices, such as in-line skate rollers and an ice skate blade, to a boot sole. Shortcomings include an inability to allow for a smooth and efficient transition between the walking mode and the skate mode and an inability to safely and securely affix the one or more inserts via a quick release buckle onto an existing boot with minimal component exchange that can be accomplished in a seamless, time efficient manner.

All documents cited herein are incorporated by reference.

It is clear that there exists a need for an interchangeable boot attachment for allowing seamless transition between a variety of boot modes through the exchange of a plurality of inserts that is assembled intuitively and performs in a secure manner. There is need for an interchangeable boot attachment that allows for a smooth and efficient transition between a walking mode and a plurality of sport modes, that is safely and securely affixed to a boot via a quick release buckle with minimal component exchange, that can be accomplished in a seamless, time efficient manner, that prevents accidental release of the insert based on the tapered dovetail channel paired with a durable lock strap and buckle-release mechanism and eliminates the hassles of having two pairs of footwear and helps to streamline the skating experience-especially on chilly days where the transition from winter boots to skates becomes painfully cold.

BRIEF SUMMARY

The following presents a simplified summary of the general inventive concepts described herein to provide a basic understanding of some aspects of the disclosure. This summary is not an extensive overview of the disclosure. It is not intended to restrict key or critical elements of embodiments of the disclosure or to delineate their scope beyond that which is explicitly or implicitly described by the following description and claims.

It is an object of the disclosure to provide an interchangeable boot attachment.

In accordance with an aspect of the disclosure, there is provided an interchangeable boot attachment, for allowing seamless transition between a variety of boot modes that is assembled intuitively and performs in a secure manner, comprising a buckle strap affixed to a baseplate around a heel of the baseplate and one or more inserts. The baseplate having an insert channel along a bottom of the baseplate that tapers from an opening at the heel towards a toe end of the baseplate and the buckle strap having a buckle that couples to a strap. The one or more inserts having a tapered projection that tapers in an identical formation to the insert channel and is coupled to the insert channel during assembly such that a dovetail joint is formed between the opening, the insert channel and the tapered projection. Wherein the buckle is rotated and snapped into a locked position to apply tension along the strap to secure the one or more inserts to the insert channel, the strap is wrapped around the heel and covering the opening in the heel that provides access to the insert channel for the one or more insert. Wherein the buckle is rotated and unsnapped into an engaged position to release the tension along the strap. Wherein the buckle is decoupled and released from the strap in an open position to remove the strap from the opening to allow for removing the one or more inserts from the insert channel and inserting the one or more inserts into the insert channel.

In one embodiment, the one or more inserts includes one or more of a gripped tread insert, a stability blade insert, a long-distance blade insert, an agility blade insert, a roller-blade insert, a roller skate insert, a ski insert, a snowshoe insert and a snowboard insert.

In one embodiment, the interchangeable boot attachment is manufactured to a boot.

In one embodiment, the baseplate is composed of a durable plastic material.

In one embodiment, the interchangeable boot attachment is affixed to an existing boot.

In one embodiment, the interchangeable boot attachment is affixed to the existing boot via a plurality of fasteners.

In one embodiment, the interchangeable boot attachment is affixed to the existing boot via an adhesive.

In one embodiment, the interchangeable boot attachment is accompanied by a carry case.

In one embodiment, the carry case is composed of a silicon fabric on a front side for added grip for handling the one or more inserts, a microfiber cloth on a back side for clearing and drying ice and snow off of the one or more inserts and a quick-drying nylon lining within a pouch of the carry case to keep the pouch dry to prevent rusting the one or more inserts.

In one embodiment, the one or more inserts comprise a cap at a back end which indicates a direction that the one or more inserts should be slid into the insert channel.

In in one embodiment, the cap is shaped in an identical formation to the opening such that the cap fills the opening providing more surface for the strap to contact and further secure the one or more inserts in place.

Other aspects, features and/or advantages will become more apparent upon reading of the following non-restrictive description of specific embodiments thereof, given by way of example only with reference to the accompanying drawings.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

In the figures, embodiments are illustrated by way of example. It is to be expressly understood that the description and figures are only for the purpose of illustration and as an aid to understanding.

Figure 1A:
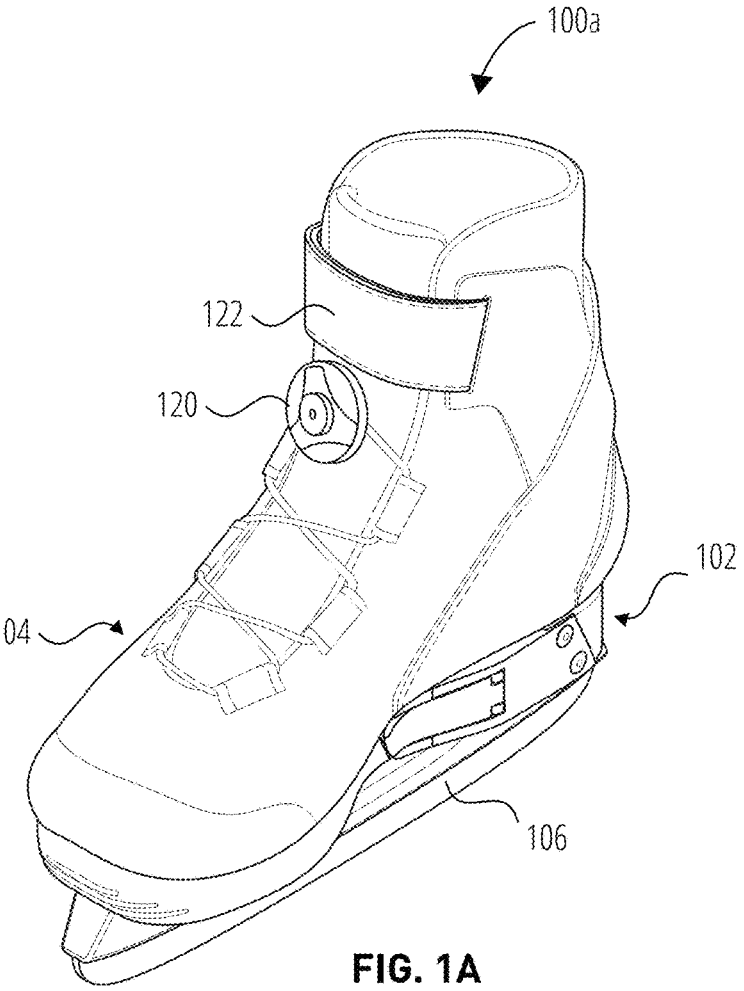

Embodiments will now be described, by way of example only, with reference to the attached figures, wherein the figures:

FIG. 1A illustrates a front perspective view of an interchangeable boot attachment affixed to a boot in accordance with one embodiment.

Figure 1B:
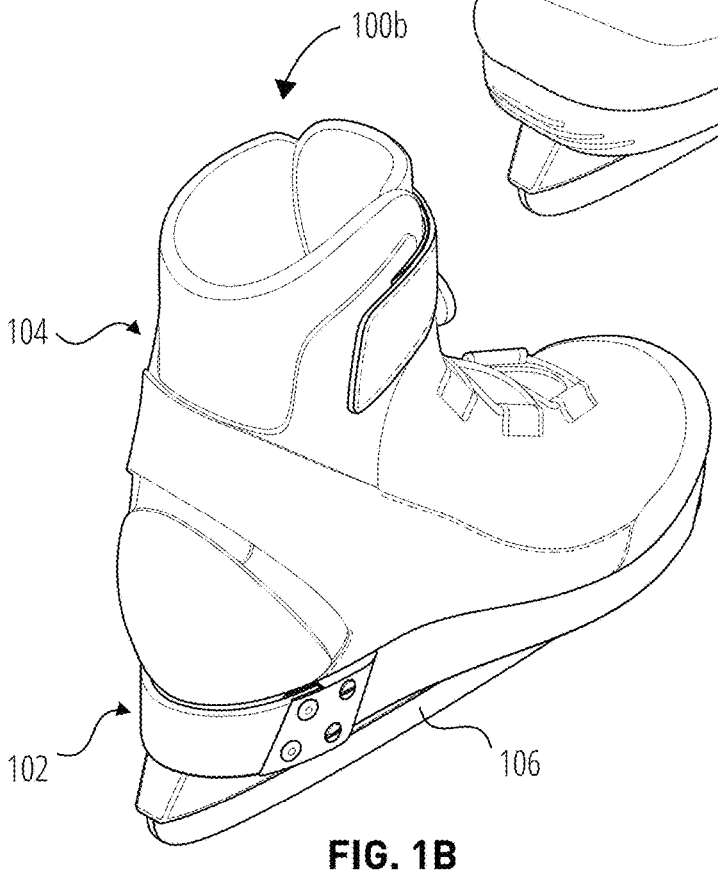

FIG. 1B illustrates a rear perspective view of an interchangeable boot attachment affixed to a boot in accordance with one embodiment.

Figure 2A:
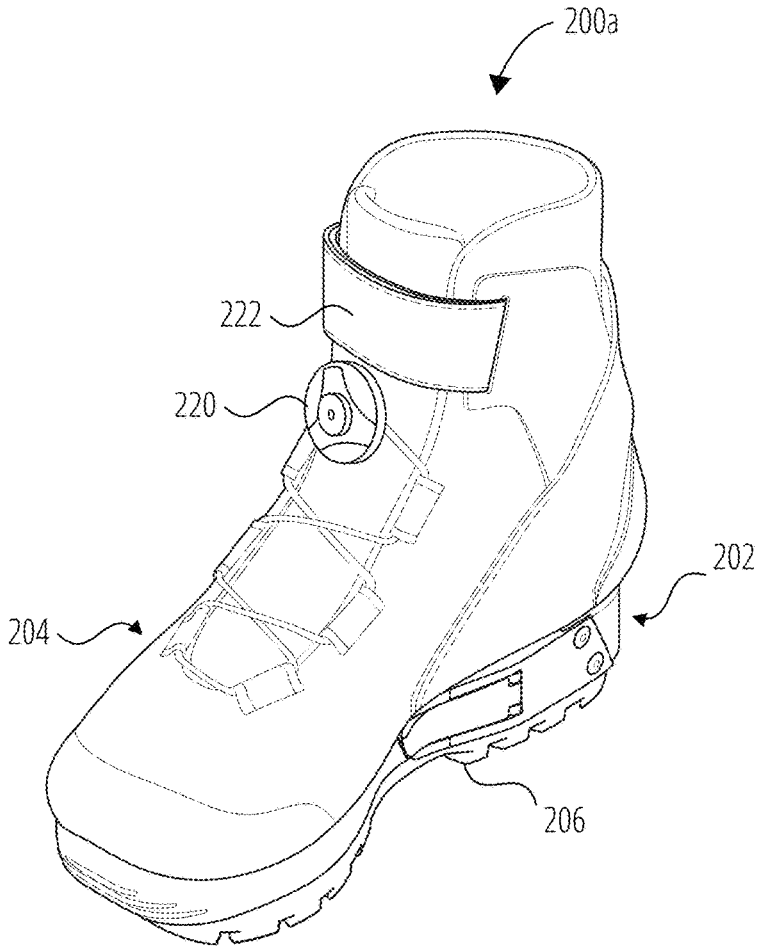

FIG. 2A illustrates a front perspective view of an interchangeable boot attachment affixed to a boot in accordance with one embodiment.

Figure 2B:
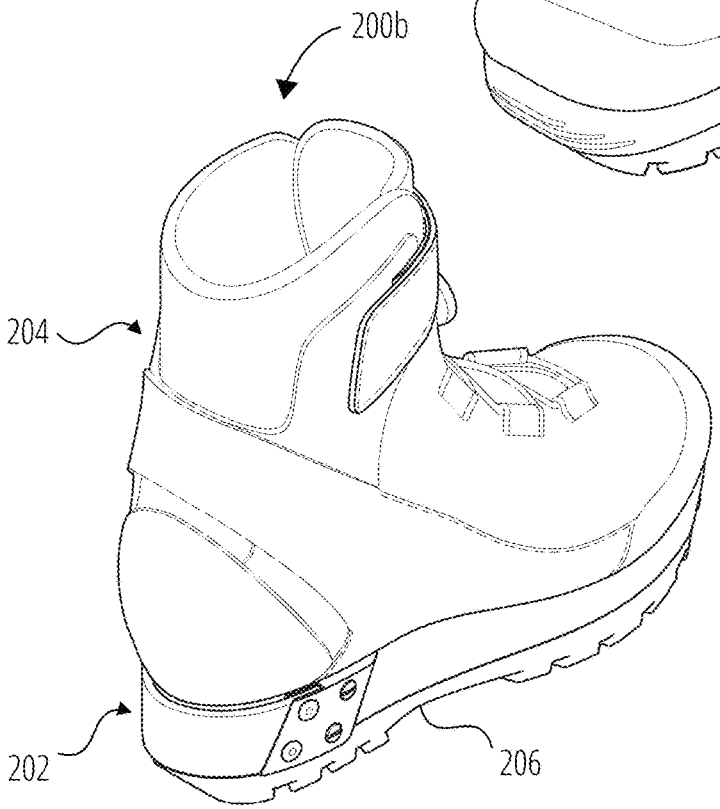

FIG. 2B illustrates a rear perspective view of an interchangeable boot attachment affixed to a boot in accordance with one embodiment.

Figure 3:
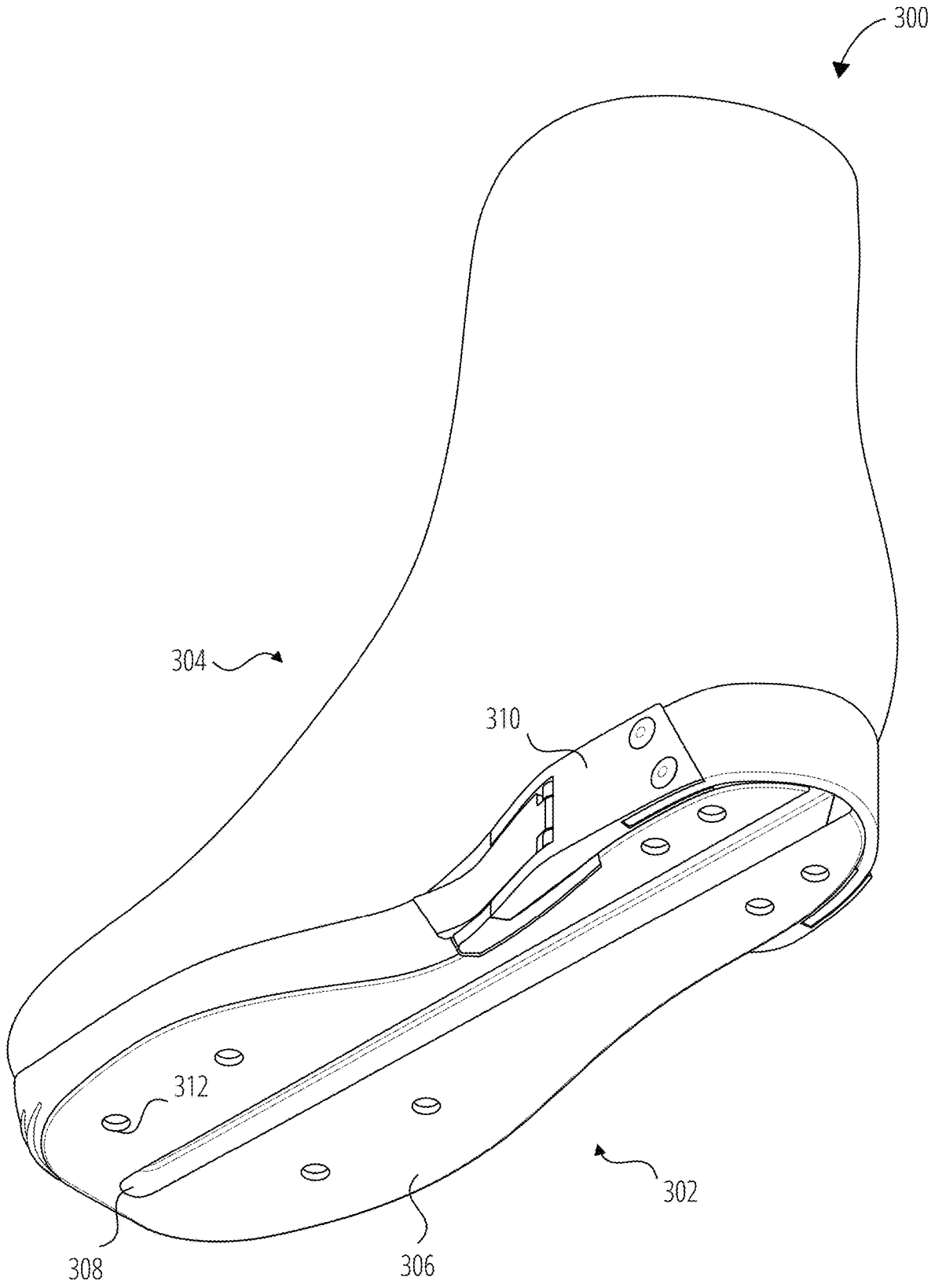

FIG. 3 illustrates an underside perspective view of an interchangeable boot attachment affixed to a boot in accordance with one embodiment.

Figure 4:
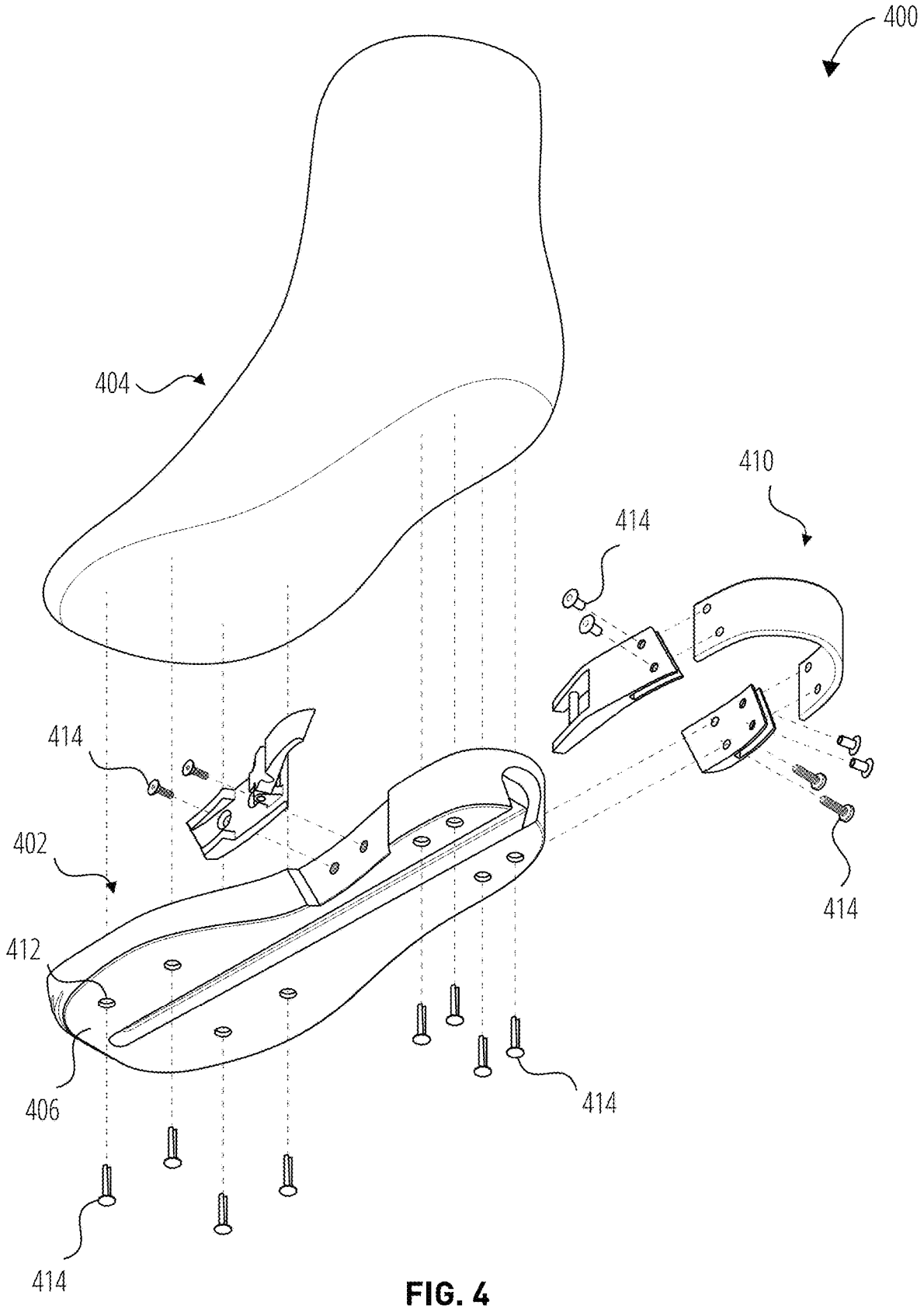

FIG. 4 illustrates an exploded view of an interchangeable boot attachment in accordance with one embodiment.

Figure 5A:
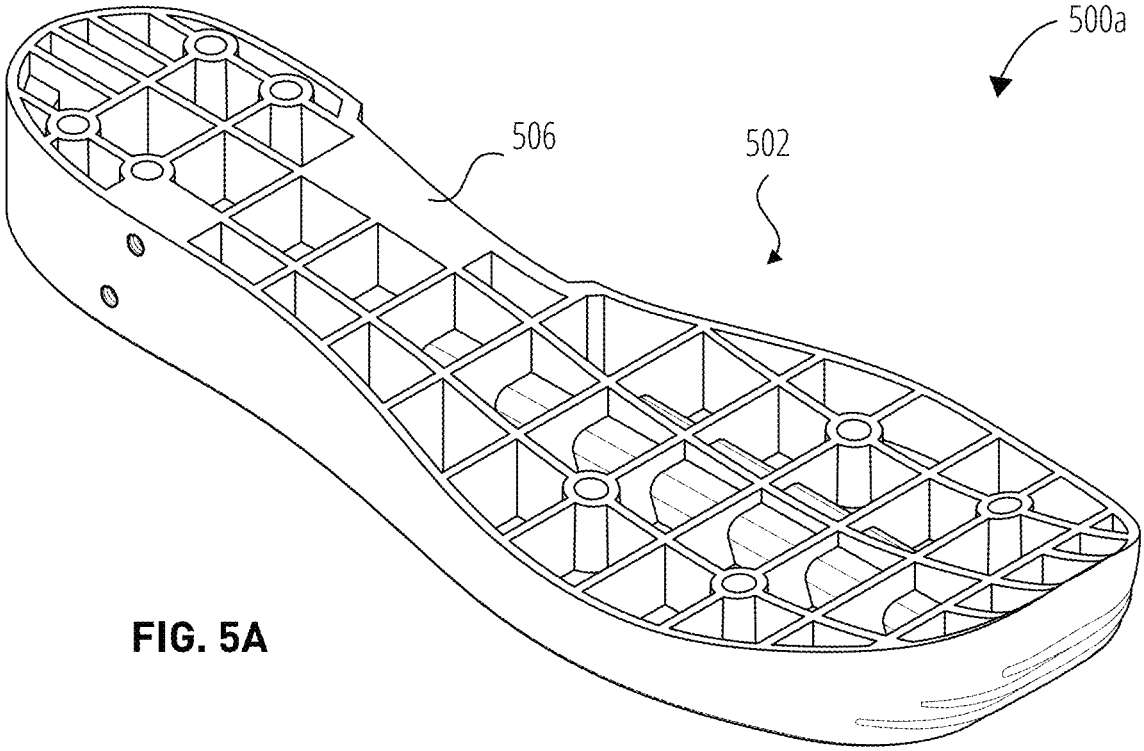

FIG. 5A illustrates a top perspective view of a baseplate of an interchangeable boot attachment in accordance with one embodiment.

Figure 5B:
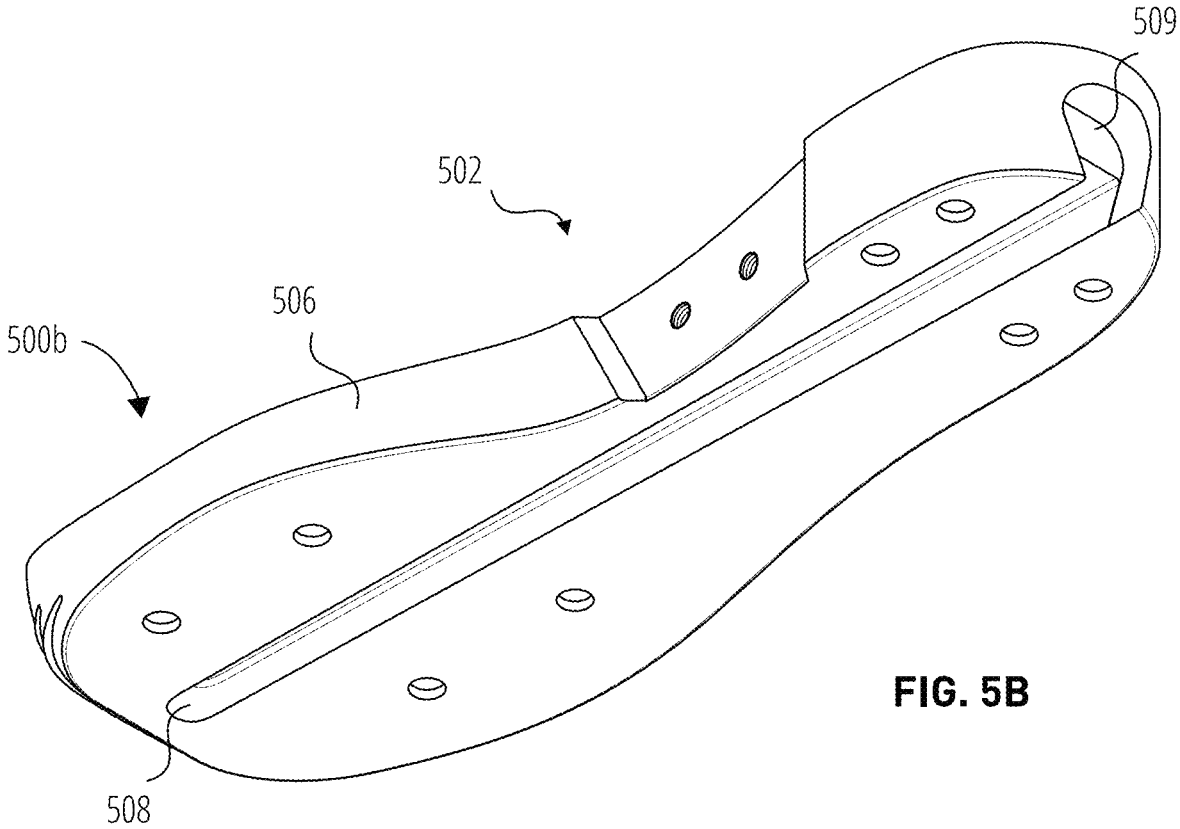

FIG. 5B illustrates an underside perspective view of a baseplate of an interchangeable boot attachment in accordance with one embodiment.

Figure 6A:
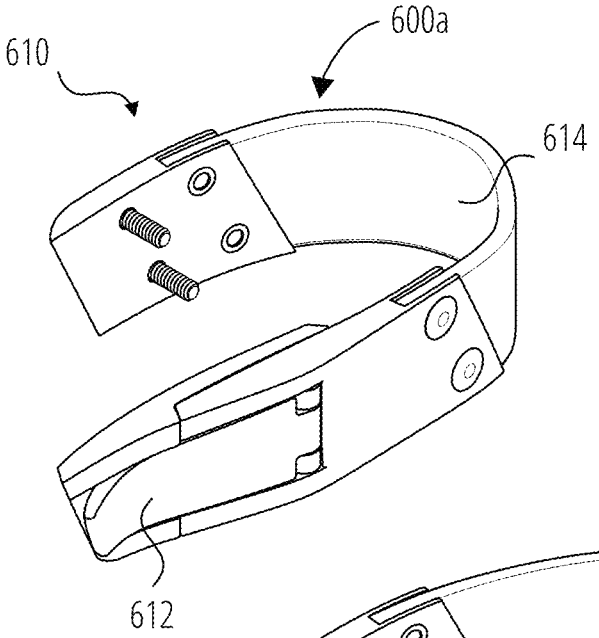

FIG. 6A illustrates a perspective view of a buckle strap of interchangeable boot attachment in accordance with one embodiment.

Figure 6B:
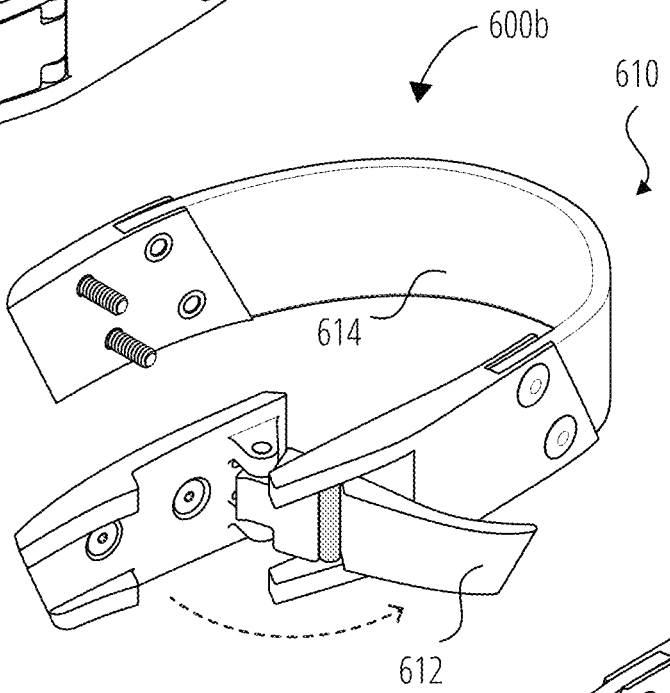

FIG. 6B illustrates a perspective view of a buckle strap of interchangeable boot attachment in accordance with one embodiment.

Figure 6C:
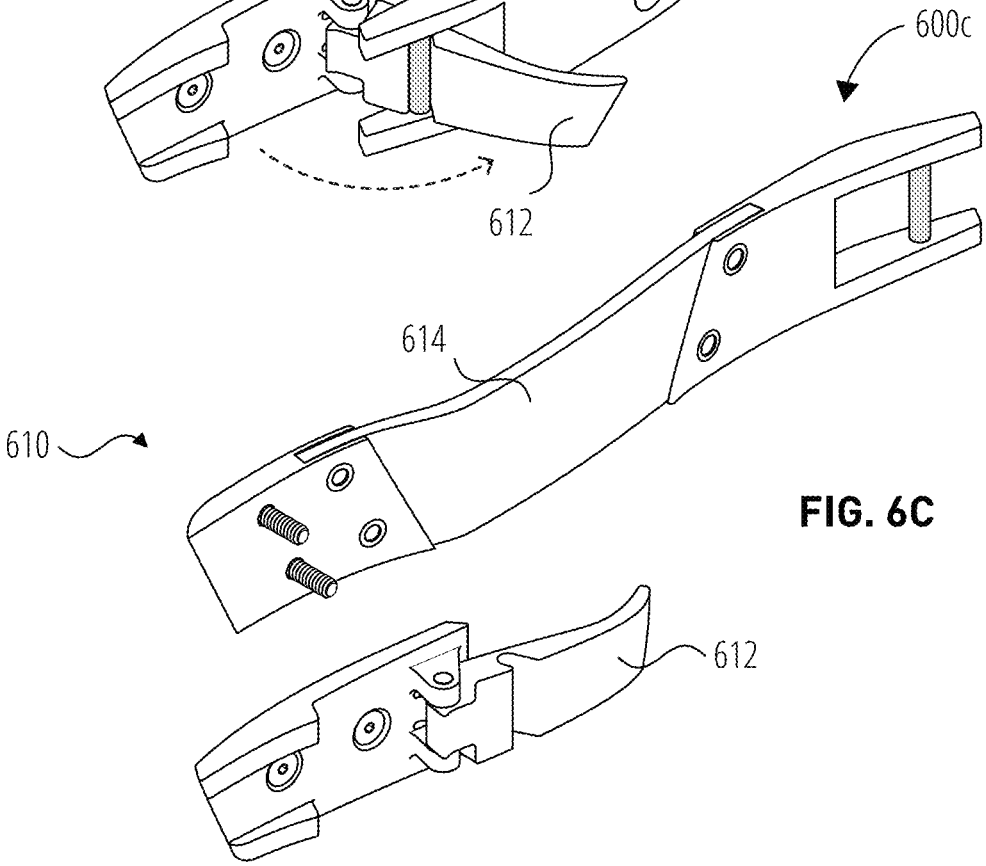

FIG. 6C illustrates a perspective view of a buckle strap of interchangeable boot attachment in accordance with one embodiment.

Figure 7A:
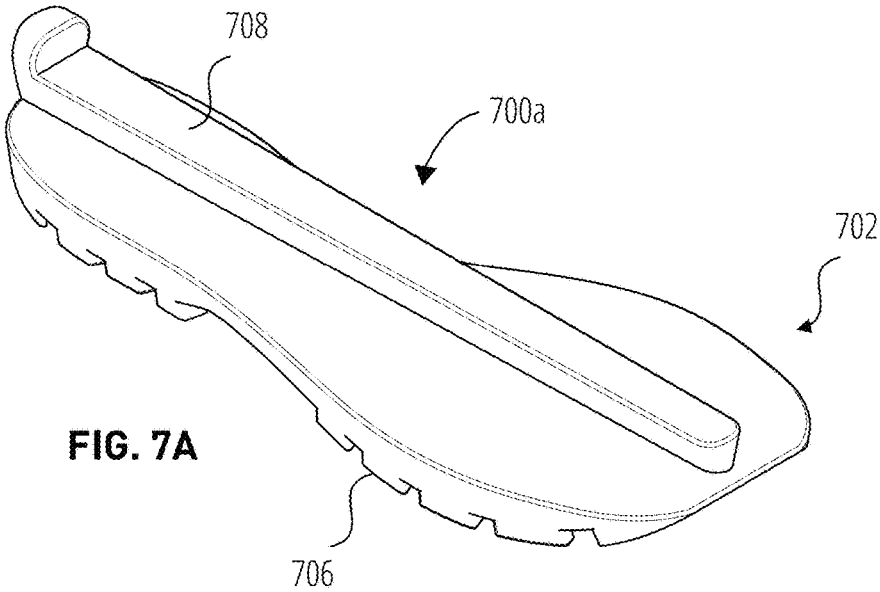

FIG. 7A illustrates a perspective view of a gripped boot insert of an interchangeable boot attachment in accordance with one embodiment.

Figure 7B:
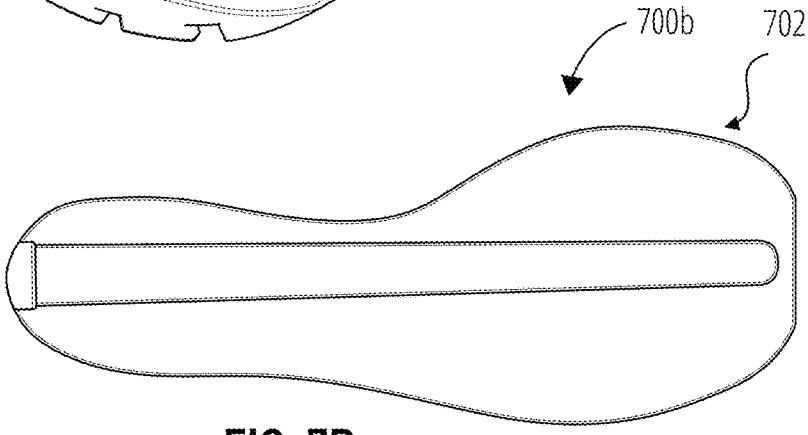

FIG. 7B illustrates a top view of a gripped boot insert of an interchangeable boot attachment in accordance with one embodiment.

Figure 7C:
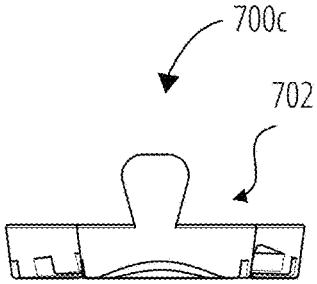

FIG. 7C illustrates a back view of a gripped boot insert of an interchangeable boot attachment in accordance with one embodiment.

Figure 7D:
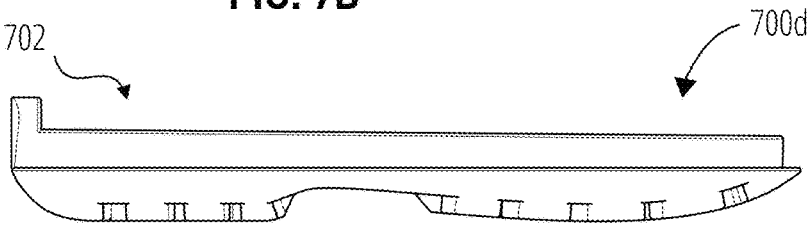

FIG. 7D illustrates a profile view of a gripped boot insert of an interchangeable boot attachment in accordance with one embodiment.

Figure 7E:
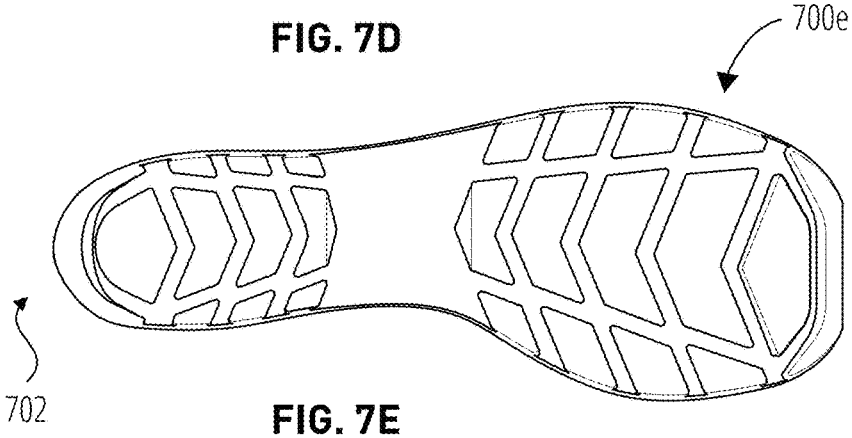

FIG. 7E illustrates a bottom view of a gripped boot insert of an interchangeable boot attachment in accordance with one embodiment.

FIG. 8A illustrates a perspective view of a stability blade insert of an interchangeable boot attachment in accordance with one embodiment.

FIG. 8B illustrates a top view of a stability blade insert of an interchangeable boot attachment in accordance with one embodiment.

FIG. 8C illustrates a back view of a stability blade insert of an interchangeable boot attachment in accordance with one embodiment.

FIG. 8D illustrates a profile view of a stability blade insert of an interchangeable boot attachment in accordance with one embodiment.

FIG. 8E illustrates a bottom view of a stability blade insert of an interchangeable boot attachment in accordance with one embodiment.

Figure 9A:
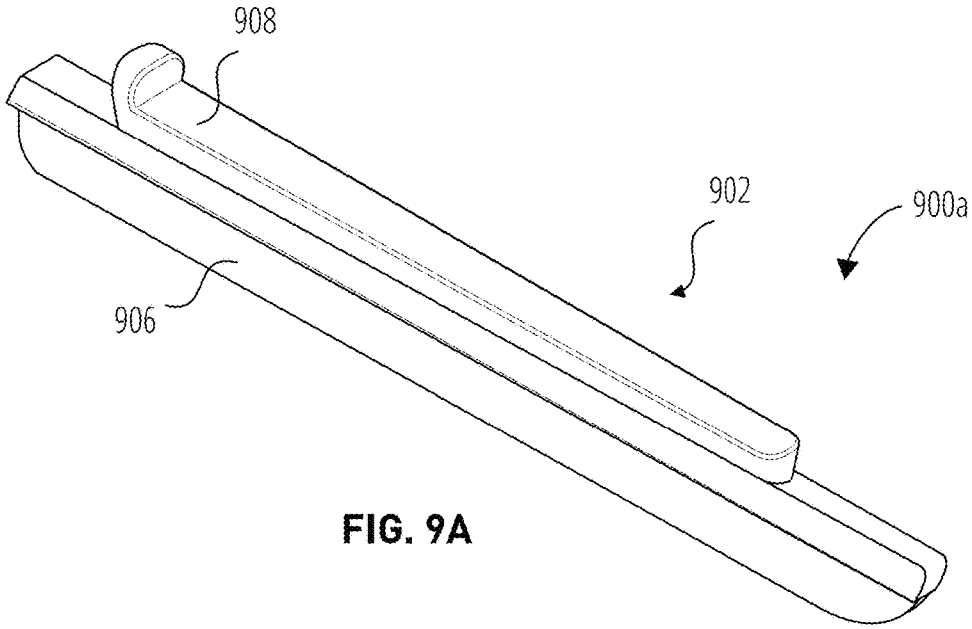

FIG. 9A illustrates a perspective view of a long-distance blade insert of an interchangeable boot attachment in accordance with one embodiment.

Figure 9B:
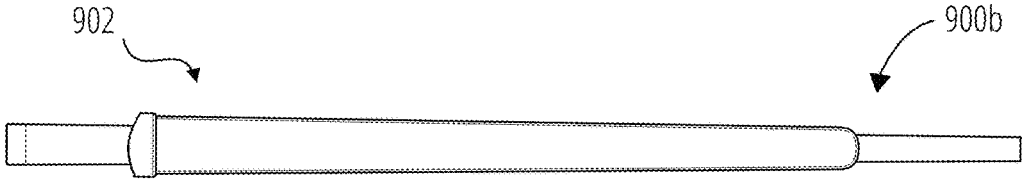

FIG. 9B illustrates a top view of a long-distance blade insert of an interchangeable boot attachment in accordance with one embodiment.

Figure 9C:
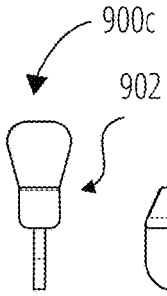

FIG. 9C illustrates a back view of a long-distance blade insert of an interchangeable boot attachment in accordance with one embodiment.

Figure 9D:
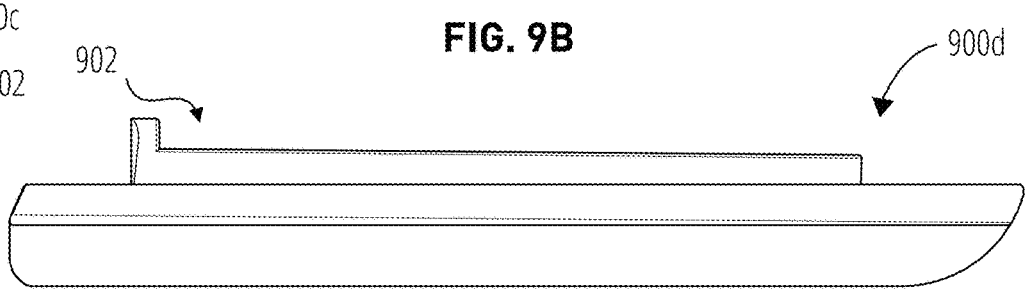

FIG. 9D illustrates a profile view of a long-distance blade insert of an interchangeable boot attachment in accordance with one embodiment.

Figure 9E:
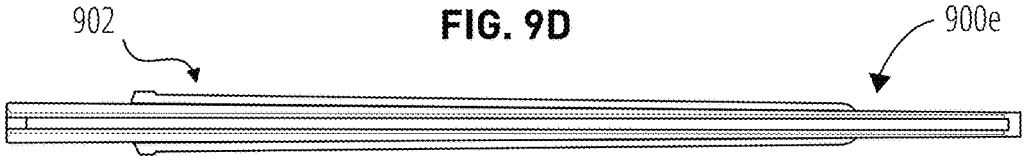

FIG. 9E illustrates a bottom view of a long-distance blade insert of an interchangeable boot attachment in accordance with one embodiment.

Figure 10A:
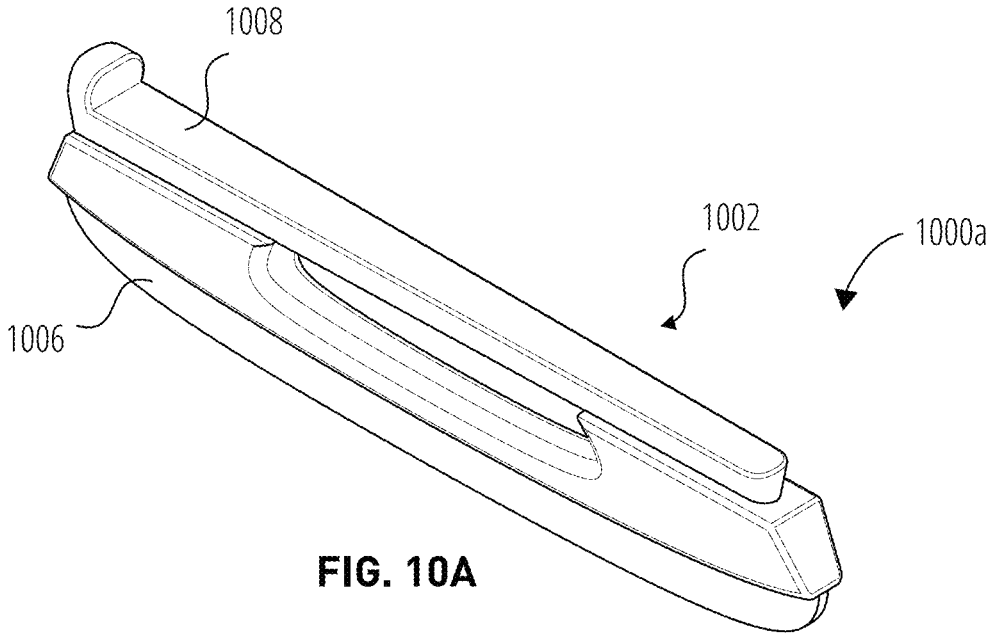

FIG. 10A illustrates a perspective view of an agility blade insert of an interchangeable boot attachment in accordance with one embodiment.

Figure 10B:
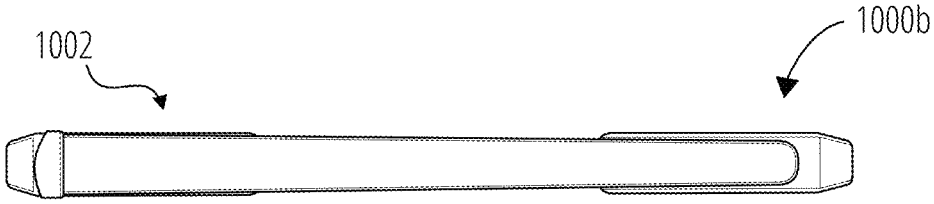

FIG. 10B illustrates a top view of an agility blade insert of an interchangeable boot attachment in accordance with one embodiment.

Figure 10C:
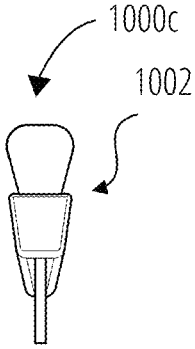

FIG. 10C illustrates a back view of an agility blade insert of an interchangeable boot attachment in accordance with one embodiment.

Figure 10D:
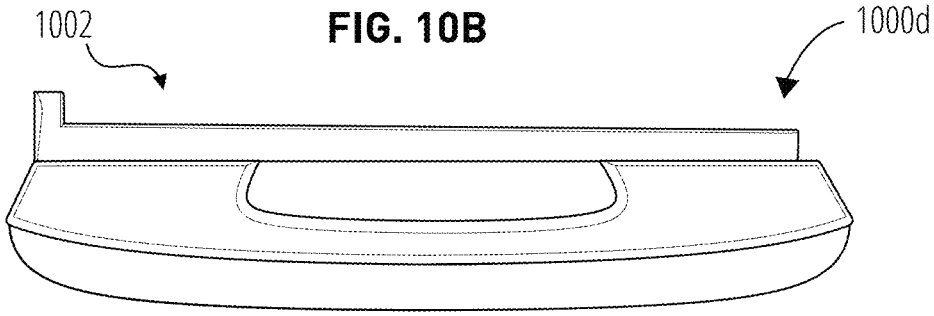

FIG. 10D illustrates a profile view of an agility blade insert of an interchangeable boot attachment in accordance with one embodiment.

Figure 10E:
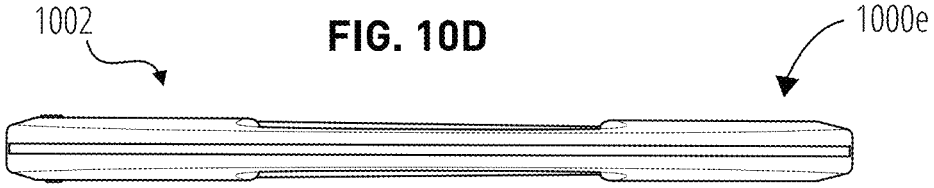

FIG. 10E illustrates a bottom view of an agility blade insert of an interchangeable boot attachment in accordance with one embodiment.

Figure 11A:
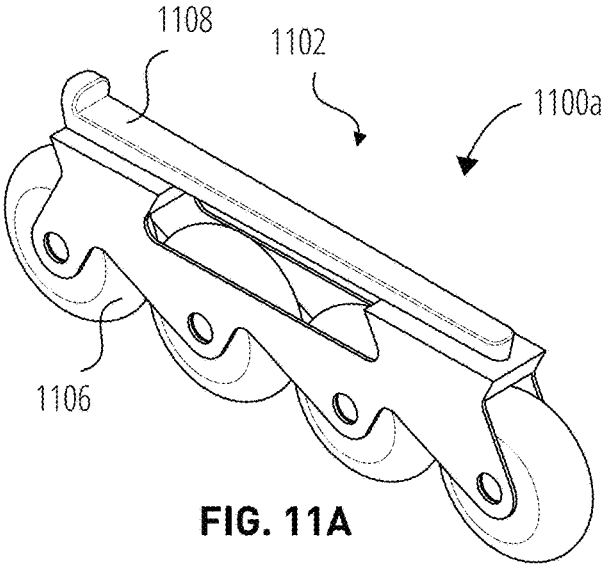

FIG. 11A illustrates a perspective view of a rollerblade insert of an interchangeable boot attachment in accordance with one embodiment.

Figure 11B:
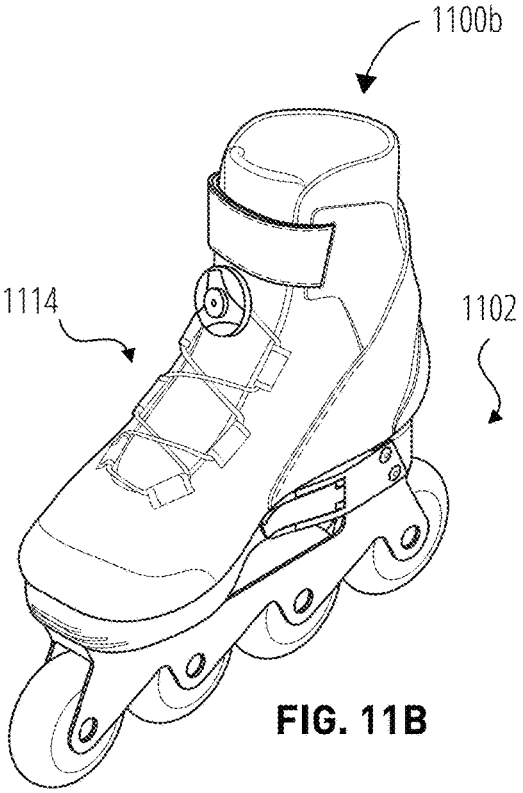

FIG. 11B illustrates a perspective view of a rollerblade insert affixed to a boot in accordance with one embodiment.

Figure 11C:
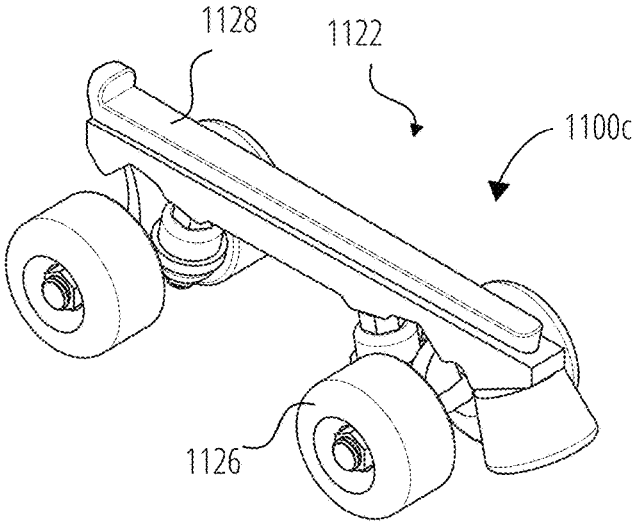

FIG. 11C illustrates a perspective view of a roller skate insert of an interchangeable boot attachment in accordance with one embodiment.

Figure 11D:
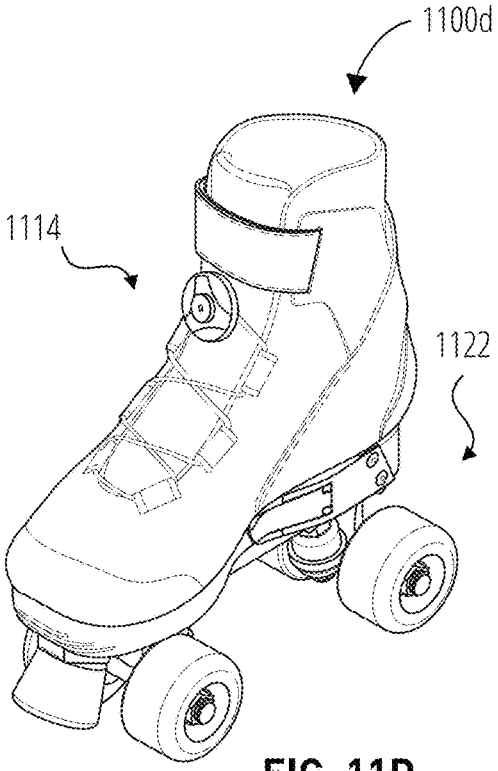

FIG. 11D illustrates a perspective view of a roller skate insert affixed to a boot in accordance with one embodiment.

Figure 12A:
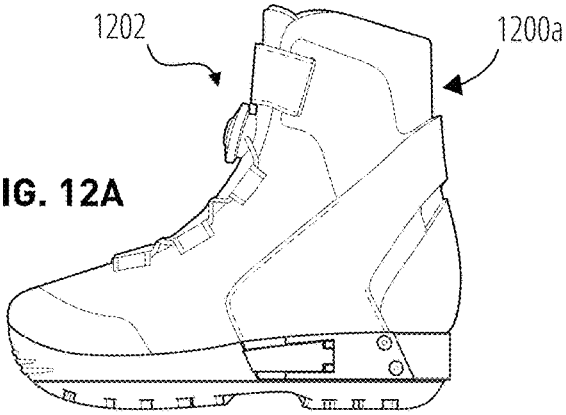

FIG. 12A illustrates a profile view of a winter boot in accordance with one embodiment.

Figure 12B:
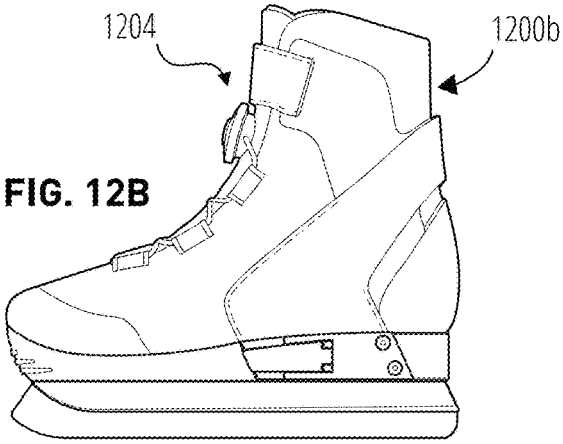

FIG. 12B illustrates a profile view of a stability skate in accordance with one embodiment.

Figure 12C:
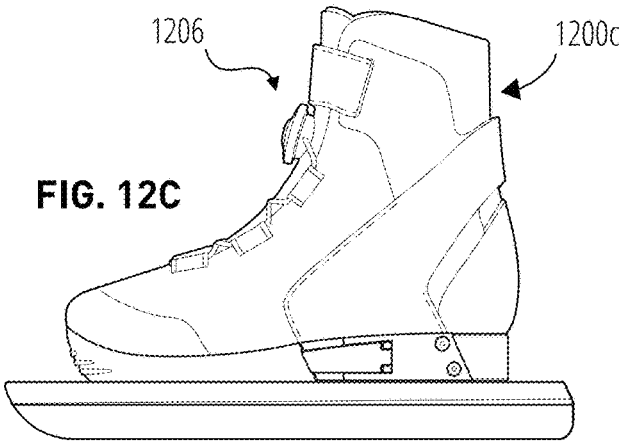

FIG. 12C illustrates a profile view of a long-distance skate in accordance with one embodiment.

Figure 12D:
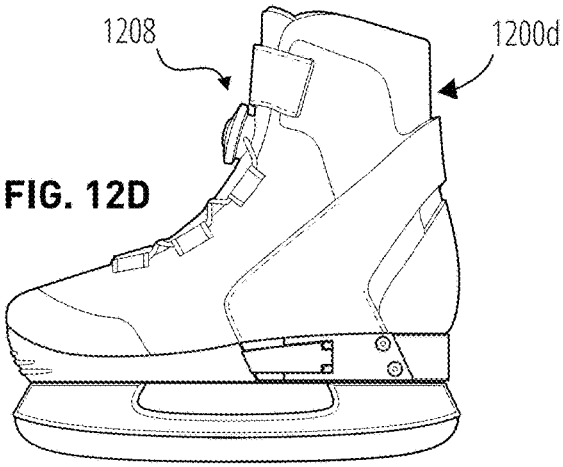

FIG. 12D illustrates a profile view of an agility skate in accordance with one embodiment.

Figure 12E:
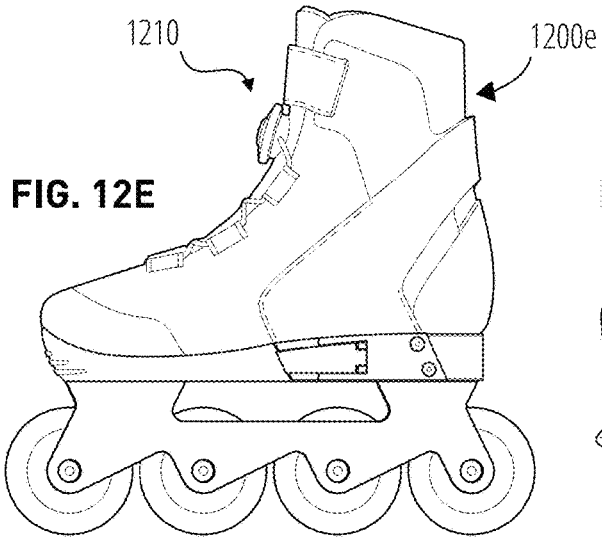

FIG. 12E illustrates a profile view of a rollerblade in accordance with one embodiment.

Figure 12F:
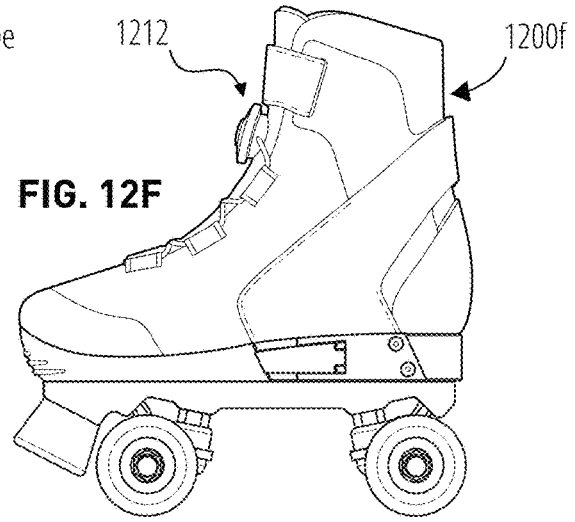

FIG. 12F illustrates a profile view of a roller skate in accordance with one embodiment.

Figure 13A:
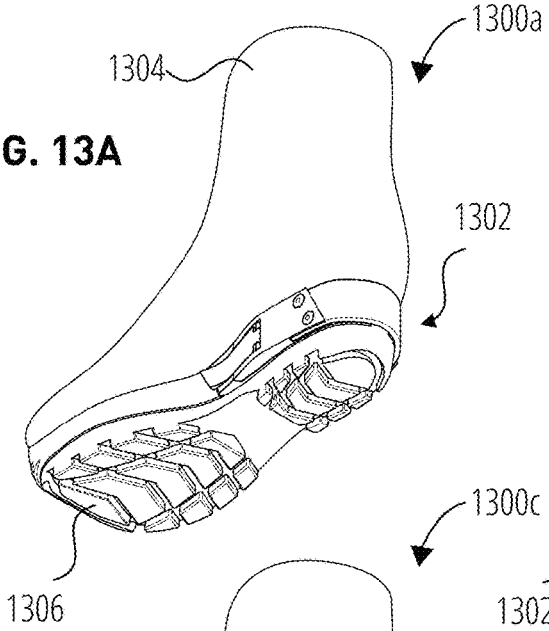

FIG. 13A illustrates a perspective view of an interchangeable boot attachment coupled to a boot in accordance with one embodiment.

Figure 13B:
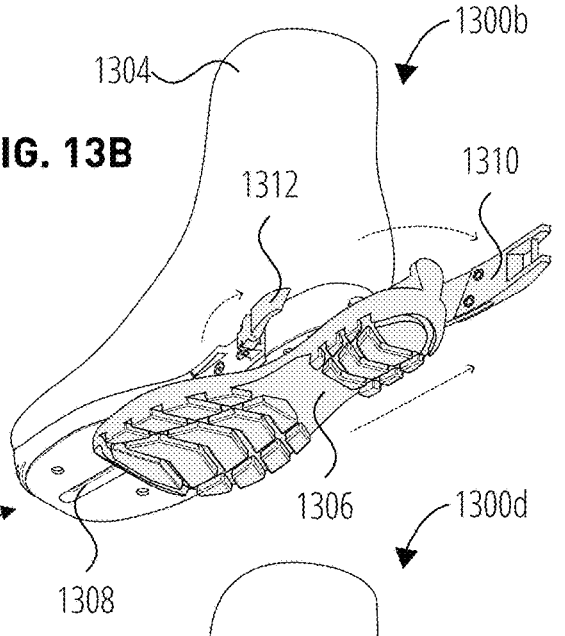

FIG. 13B illustrates a perspective view of an interchangeable boot attachment coupled to a boot in accordance with one embodiment.

Figure 13C:
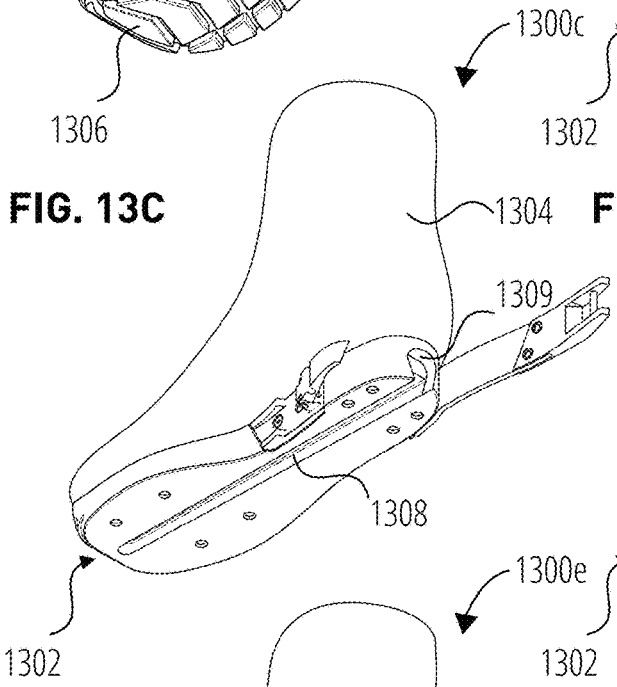

FIG. 13C illustrates a perspective view of an interchangeable boot attachment coupled to a boot in accordance with one embodiment.

Figure 13D:
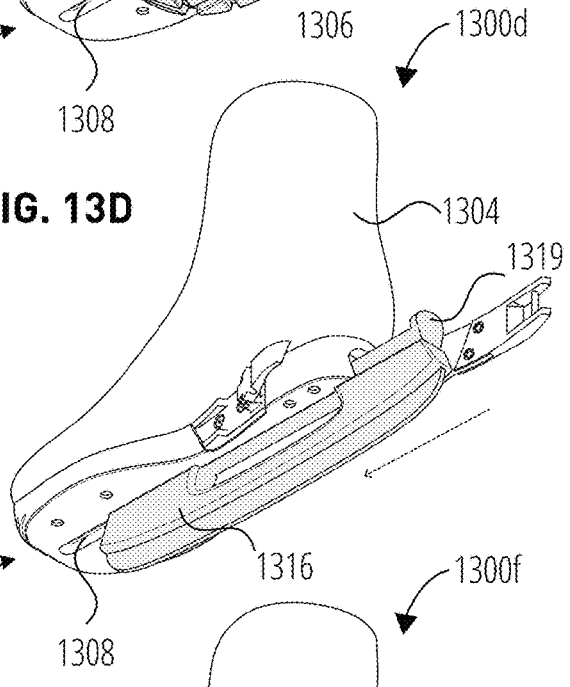

FIG. 13D illustrates a perspective view of an interchangeable boot attachment coupled to a boot in accordance with one embodiment.

Figure 13E:
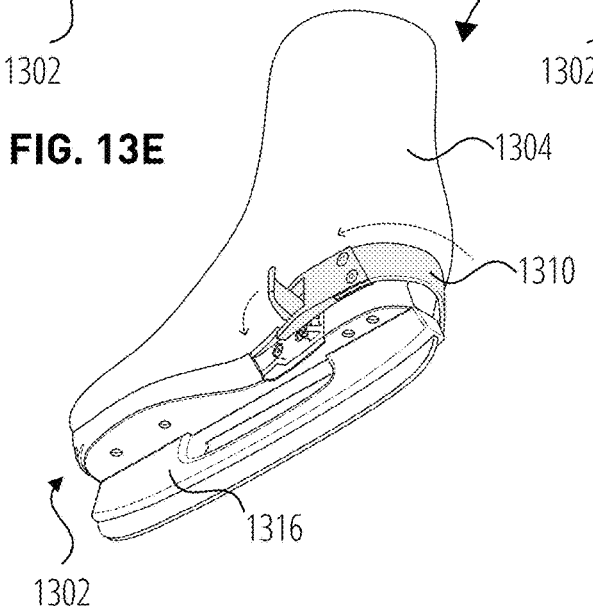

FIG. 13E illustrates a perspective view of an interchangeable boot attachment coupled to a boot in accordance with one embodiment.

Figure 13F:
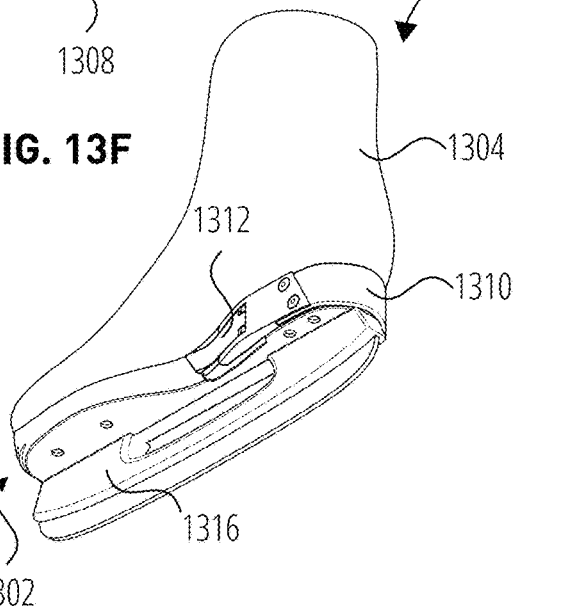

FIG. 13F illustrates a perspective view of an interchangeable boot attachment coupled to a boot in accordance with one embodiment.

Figure 14A:
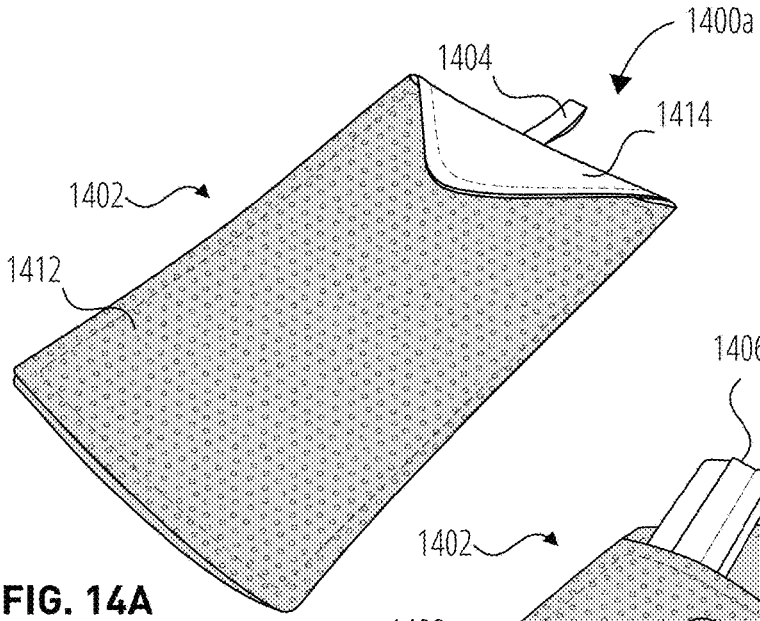

FIG. 14A illustrates a front perspective view of carry case in accordance with one embodiment.

Figure 14B:
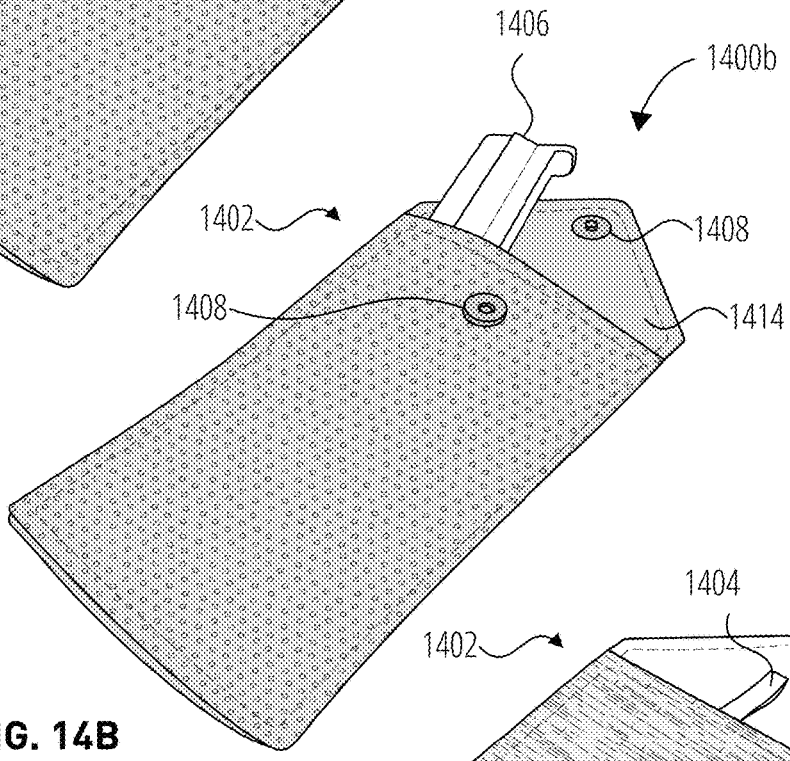

FIG. 14B illustrates a front perspective view of carry case in accordance with one embodiment.

Figure 14C:
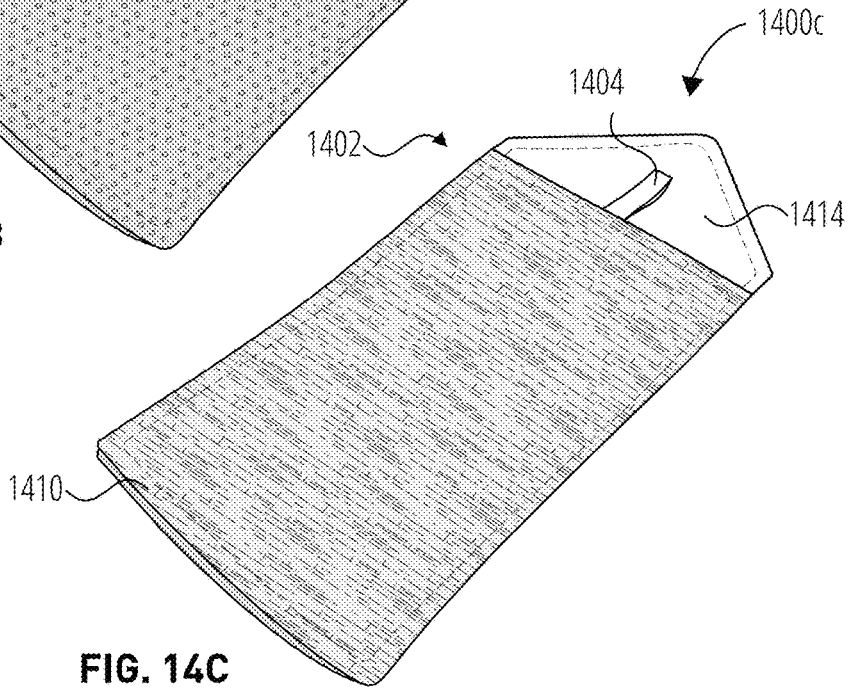

FIG. 14C illustrates a back perspective view of carry case in accordance with one embodiment.

DETAILED DESCRIPTION

The details of one or more embodiments of the subject matter of this specification are set forth in the accompanying drawings and the description below. Other features, aspects, and advantages of the subject matter will become apparent from the description, the drawings, and the claims.

The disclosure proposes an interchangeable boot attachment for allowing seamless transition between a variety of boot modes through the exchange of a plurality of inserts that is assembled intuitively and performs in a secure manner that overcomes disadvantages inherent in the existing interchangeable boot attachments. The present disclosure provides an interchangeable boot attachment that may be used with many different embodiments. As such, the general purpose of the present disclosure, which will be described subsequently in greater detail, is to provide a new and improved interchangeable boot attachment that allows for a smooth and efficient transition between a walking mode and a plurality of sport modes, that is safely and securely affixed to a boot via a quick release buckle with minimal component exchange, that can be accomplished in a seamless, time efficient manner, that prevents accidental release of the skate based on the tapered dovetail channel paired with a durable lock strap and buckle-release mechanism and eliminates the hassles of having two pairs of footwear and helps to streamline the skating experience-especially on chilly days where the transition from winter boots to skates becomes painfully cold, which provides the advantages and overcomes the aforementioned disadvantages.

FIG. 1A illustrates a front perspective view 100*a* of an interchangeable boot attachment 102 affixed to a boot 104, according to some embodiments. In the embodiment shown a skate insert 106 is attached to a boot 104 allowing for the user to ice skate. This embodiment also features two points of tightening: a turn-dial 120 at the mid ankle for quick, effortless, and highly secure lacing, along with a Velcro strap 122 around the high ankle that tightens the ankle cuff. The benefit of this two-part system is that the user can easily adjust the tightness to find the optimal combination for both walking and skating respectively, for personal comfort.

FIG. 1B illustrates a rear perspective view 100*b* of an interchangeable boot attachment 102 affixed to a boot 104, according to some embodiments. In the embodiment shown a skate insert 106 is attached to a boot 104 allowing for the user to ice skate.

FIG. 2A illustrates a front perspective view 200*a* of an interchangeable boot attachment 202 affixed to a boot 204, according to some embodiments. In the embodiment shown a gripped tread insert 206 is attached to a boot 204 allowing for the user to hike. This embodiment also features two points of tightening: a turn-dial 220 at the mid ankle for quick, effortless, and highly secure lacing, along with a Velcro strap 222 around the high ankle that tightens the ankle cuff.

Furthermore, the boot 204 may be customizable in some embodiments, such as the use of specific materials and construction of the boot 204 itself along with the assembly of the interchangeable boot attachment 202 at the discretion of a partner company specializing in footwear design and manufacturing.

FIG. 2B illustrates a rear perspective view 200*b* of an interchangeable boot attachment 202 affixed to a boot 204, according to some embodiments. In the embodiment shown a gripped tread insert 206 is attached to a boot 204 allowing for the user to hike.

FIG. 3 illustrates an underside perspective view 300 of an interchangeable boot attachment 302 affixed to a boot 304, according to some embodiments. The interchangeable boot attachment 302 is shown comprising a baseplate 306 coupled to a buckle strap 310. The baseplate 306 contains an insert channel 308 along the center of the base that starts at the heel end and tapers towards the end of the toe end. The tapered nature of the insert channel 308 is employed to ensure a secure and snug fit once an insert is attached to the baseplate 306. A plurality of assembly channels 312 are shown which are employed in some embodiments to affix the baseplate 306 to a boot 304.

In some embodiments, the baseplate 306 features a recess on the inner side, along with four threaded holes (two on either side) that nest in and secure a quick release locking mechanism, shown as buckle strap 310. In some embodiments, the baseplate 306 features a curved toe edge to support a natural walking stride.

FIG. 4 illustrates an exploded view 400 of an interchangeable boot attachment 402, according to some embodiments. In the embodiment shown, a plurality of fasteners 414 are each shown coupling to a plurality of assembly channels 412 for affixing the baseplate 406 to the boot 404 as well as coupling the buckle strap 410 to the baseplate 406. Examples of fasteners 414 include, but are not limited to, split rivets, screws, threaded inserts, hollow rivets, etc. In some embodiments, the baseplate 406 is affixed to the boot 404 via an adhesive. In some embodiments, one or more of the baseplate 406 and the buckle strap 410 are molded to the boot 404 during the manufacturing process. In some embodiments, the baseplate 406 is composed of a durable plastic material.

FIG. 5A illustrates a top perspective view 500*a* of a baseplate 506 of an interchangeable boot attachment 502, according to some embodiments.

FIG. 5B illustrates an underside perspective view 500*b* of a baseplate 506 of an interchangeable boot attachment 502, according to some embodiments. In the embodiment shown, an opening 509 at the heel of the baseplate 506 provides an entrance to the insert channel 508, which is where an insert may be passed through when attaching an insert to the interchangeable boot attachment 502.

FIG. 6A illustrates a perspective view 600*a* of a buckle strap 610 of interchangeable boot attachment 502, according to some embodiments. In the embodiment shown, a buckle 612 from the buckle strap 610 is coupled to a strap 614 of the buckle strap 610 such that the buckle strap 610 is in a locked position. In this position, the buckle strap 610 is under tension and covers the opening 509 of the baseplate 506, locking an insert within the insert channel 508 and affixing the insert to the baseplate 506 for safe use of the interchangeable boot attachment 502. In some embodiments, the buckle strap 610 features a durable synthetic lock strap 614 and metal buckle 612 that facilitate a quick-lock and quick-release mechanism.

FIG. 6B illustrates a perspective view 600*b* of a buckle strap 610 of interchangeable boot attachment 502, according to some embodiments. In the embodiment shown, the buckle 612 is rotated about the strap 614 from the locked position and unsnapped into an engaged position such that the tension on the strap 614 is released.

Conversely, from the engaged position, the buckle 612 may be rotated in the reverse direction about the strap 614 from the engaged position and snapped into the locked position such that the tension applied along the strap 614 that is wrapped around the heel and covering an opening 509 of the baseplate 506 that provides access to the insert channel 508 for one or more inserts.

FIG. 6C illustrates a perspective view 600*c* of a buckle strap 610 of interchangeable boot attachment 502, according to some embodiments. In the embodiment shown, the buckle 612 is completely decoupled and removed from the strap 614 and the buckle strap 610 is in an open position such that the opening 509 of the baseplate 506 is exposed and an insert may be removed or inserted into the insert channel 508. More specifically, in some embodiments the strap 614 is semi-flexible and wraps around the heel of the baseplate 506, covering the capped end of the insert located at the open end of the insert channel 508, and secures the insert in place by engaging and snapping shut the buckle 612.

FIG. 7A illustrates a perspective view 700*a* of a gripped tread insert 702 of an interchangeable boot attachment 502, according to some embodiments. In the embodiment shown, the gripped tread insert 702 is shown comprising a tapered projection 708 along the top with a plurality of gripping members 706 along the bottom. In some embodiments, the gripped tread insert 702 is made of rubber. In some embodiments, the gripped tread insert 702 is made of metal and the gripping members 706 contain spikes to increase traction for uses such as hiking or as a winter boot. The tapered projection 708 tapers in an identical formation to that of the insert channel 508 and is coupled to the insert channel 508 of the baseplate 506 during assembly such that a dovetail joint is formed between the opening 509, the insert channel 508 and the tapered projection 708. In some embodiments, the gripped tread insert 702 is a treaded rubber winter boot sole insert.

FIG. 7B illustrates a top view 700*b* of a gripped tread insert 702 of an interchangeable boot attachment 502, according to some embodiments.

FIG. 7C illustrates a back view 700*c* of a gripped tread insert 702 of an interchangeable boot attachment 502, according to some embodiments.

FIG. 7D illustrates a profile view 700*d* of a gripped tread insert 702 of an interchangeable boot attachment 502, according to some embodiments.

FIG. 7E illustrates a bottom view 700*e* of a gripped tread insert 702 of an interchangeable boot attachment 502, according to some embodiments.

FIG. 8A illustrates a perspective view 800*a* of a stability blade insert 802 of an interchangeable boot attachment 502, according to some embodiments. In the embodiment shown, the stability blade insert 802 is shown comprising a tapered projection 808 along the top with a stability blade 806 along the bottom. The tapered projection 808 tapers in an identical formation to that of the insert channel 508 and is coupled to the insert channel 508 of the baseplate 506 during assembly such that a dovetail joint is formed between the opening 509, the insert channel 508 and the tapered projection 808. In some embodiments, the stability blade 806 is a low, flat, thick and medium-length blade.

FIG. 8B illustrates a top view 800*b* of a stability blade insert 802 of an interchangeable boot attachment 502, according to some embodiments.

FIG. 8C illustrates a back view 800*c* of a stability blade insert 802 of an interchangeable boot attachment 502, according to some embodiments.

FIG. 8D illustrates a profile view 800*d* of a stability blade insert 802 of an interchangeable boot attachment 502, according to some embodiments.

FIG. 8E illustrates a bottom view 800*e* of a stability blade insert 802 of an interchangeable boot attachment 502, according to some embodiments.

FIG. 9A illustrates a perspective view 900*a* of a long-distance blade insert 902 of an interchangeable boot attachment 502, according to some embodiments. In the embodiment shown, the long-distance blade insert 902 is shown comprising a tapered projection 908 along the top with a long-distance blade 906 along the bottom. The tapered projection 908 tapers in an identical formation to that of the insert channel 508 and is coupled to the insert channel 508 of the baseplate 506 during assembly such that a dovetail joint is formed between the opening 509, the insert channel 508 and the tapered projection 908. In some embodiments, the long-distance blade 906 is a low, flat, thin and long-length blade.

FIG. 9B illustrates a top view 900*b* of a long-distance blade insert 902 of an interchangeable boot attachment 502, according to some embodiments.

FIG. 9C illustrates a back view 900*c* of a long-distance blade insert 902 of an interchangeable boot attachment 502, according to some embodiments.

FIG. 9D illustrates a profile view 900*d* of a long-distance blade insert 902 of an interchangeable boot attachment 502, according to some embodiments.

FIG. 9E illustrates a bottom view 900*e* of a long-distance blade insert 902 of an interchangeable boot attachment 502, according to some embodiments.

FIG. 10A illustrates a perspective view 1000*a* of an agility blade insert 1002 of an interchangeable boot attachment 502, according to some embodiments. In the embodiment shown, the agility blade insert 1002 is shown comprising a tapered projection 1008 along the top with an agility blade 1006 along the bottom. The tapered projection 1008 tapers in an identical formation to that of the insert channel 508 and is coupled to the insert channel 508 of the baseplate 506 during assembly such that a dovetail joint is formed between the opening 509, the insert channel 508 and the tapered projection 1008. In some embodiments, the agility blade 1006 is a high, rocker, and short-length blade.

FIG. 10B illustrates a top view 1000*b* of an agility blade insert 1002 of an interchangeable boot attachment 502, according to some embodiments.

FIG. 10C illustrates a back view 1000*c* of an agility blade insert 1002 of an interchangeable boot attachment 502, according to some embodiments.

FIG. 10D illustrates a profile view 1000*d* of an agility blade insert 1002 of an interchangeable boot attachment 502, according to some embodiments.

FIG. 10E illustrates a bottom view 1000*e* of an agility blade insert 1002 of an interchangeable boot attachment 502, according to some embodiments.

FIG. 11A illustrates a perspective view 1100*a* of a rollerblade insert 1102 of an interchangeable boot attachment 502, according to some embodiments. In the embodiment shown, the rollerblade insert 1102 is shown comprising a tapered projection 1108 along the top with a set of rollerblade wheels 1106 along the bottom. The tapered projection 1108 tapers in an identical formation to that of the insert channel 508 and is coupled to the insert channel 508 of the baseplate 506 during assembly such that a dovetail joint is formed between the opening 509, the insert channel 508 and the tapered projection 1108.

FIG. 11B illustrates a perspective view 1100*b* of a rollerblade insert 1102 affixed to a boot 1114, according to some embodiments. In the embodiment shown a rollerblade insert 1102 is attached to a boot 1114 allowing for the user go rollerblading.

FIG. 11C illustrates a perspective view 1100*c* of a roller skate insert 1122 of an interchangeable boot attachment 502, according to some embodiments. In the embodiment shown, the roller skate insert 1122 is shown comprising a tapered projection 1128 along the top with a set of roller skate wheels 1126 along the bottom. The tapered projection 1128 tapers in an identical formation to that of the insert channel 508 and is coupled to the insert channel 508 of the baseplate 506 during assembly such that a dovetail joint is formed between the opening 509, the insert channel 508 and the tapered projection 1128.

FIG. 11D illustrates a perspective view 1100*d* of a roller skate insert 1112 affixed to a boot 1114, according to some embodiments. In the embodiment shown a roller skate insert 1112 is attached to a boot 1114 allowing for the user to go roller skating. In other embodiments, the interchangeable boot attachment 502 may be a ski insert, a snowshoe insert or a snowboard insert.

FIG. 12A illustrates a profile view 1200*a* of a winter boot 1202, according to some embodiments.

FIG. 12B illustrates a profile view 1200*b* of a stability skate 1204, according to some embodiments.

FIG. 12C illustrates a profile view 1200*c* of a long-distance skate 1206, according to some embodiments.

FIG. 12D illustrates a profile view 1200*d* of an agility skate 1208, according to some embodiments.

FIG. 12E illustrates a profile view 1200*e* of a rollerblade 1210, according to some embodiments.

FIG. 12F illustrates profile view 1200*f* of a roller skate 1212, according to some embodiments.

FIG. 13A illustrates a perspective view 1300*a* of an interchangeable boot attachment 1302 coupled to a boot 1304, according to some embodiments. In the embodiment shown, a gripped boot insert 1306 is in a locked position and the user is able to use the gripped boot insert 1306 as intended. The slide-out gripped boot insert 1306 makes it simple for the user to put their boots on in the comfort of their own home, travel and walk to their desired skating venue, and quickly switch from boot mode to skate mode or other various sport modes. The skating experience is largely dependent on the formal qualities of the blade. The consistent tapered dovetail channel and inserts are designed to enable various types of skate blades to attach to the same pair of boots. This helps users personalize and broaden their skating experiences—by choosing the blade set(s) that best cater to their current mobility needs and skill levels, and different skating environments.

FIG. 13B illustrates a perspective view 1300*b* of an interchangeable boot attachment 1302 coupled to a boot 1304, according to some embodiments. In the embodiment shown, the buckle 1312 from the interchangeable boot attachment 1302 has been released and the strap 1310 from the interchangeable boot attachment 1302 has been unlatched allowing for the user to slide the gripped boot insert 1306 out from the insert channel 1308 with the strap 1310 open. The buckle 1312 functions using a simple bar and groove as shown and is seamlessly snapped in and out for locking and unlocking.

FIG. 13C illustrates a perspective view 1300*c* of an interchangeable boot attachment 1302 coupled to a boot 1304, according to some embodiments. In the embodiment shown, the gripped boot insert 1306 has been completely slide out from along the insert channel 1308 exposing the opening 1309 and the interchangeable boot attachment 1302 is ready to receive another insert.

FIG. 13D illustrates a perspective view 1300*d* of an interchangeable boot attachment 1302 coupled to a boot 1304, according to some embodiments. In the embodiment shown, a skate insert 1316 is slid through the opening in the heel along the insert channel 1308 of the interchangeable boot attachment 1302. The skate insert 1316 is shown comprising a cap 1319 at the back end which indicates the direction that the skate insert 1316 should be slid into the insert channel 1308. The cap 1319 is shaped in an identical formation to the opening 1309 such that the cap 1319 fills the opening 1309 providing more surface for the strap 1310 to contact and further secure the skate insert 1316 in place.

FIG. 13E illustrates a perspective view 1300*e* of an interchangeable boot attachment 1302 coupled to a boot 1304, according to some embodiments. In the embodiment shown, the skate insert 1316 is further slid along the insert channel 1308 of the interchangeable boot attachment 1302 such that it has been completely inserted in the insert channel 1308 and forms a dovetail joint, helping to lock the skate insert 1316 in place, which is easy to slot in but also self-tightens.

The strap 1310 is concurrently engaged and is wrapped around the heel covering the opening in the heel, encasing the skate insert 1316. The cap 1319 at the back end of the skate insert 1316 indicates in which direction the skate insert 1316 should be slid into the insert channel 1308 and also allows the strap 1310 to contact more surface area to keep the skate insert 1316 secure and disperse the force if the skate insert 1316 were to try ejecting.

FIG. 13F illustrates a perspective view 1300*f* of an interchangeable boot attachment 1302 coupled to a boot 1304, according to some embodiments. In the embodiment shown, the buckle 1312 is snapped shut, providing tension along the strap 1310 further securing the skate insert 1316 to the interchangeable boot attachment 1302 for safe use. This assembly facilitates a swift slide interaction and ensures secure attachment of the various inserts to the interchangeable boot attachment 1302.

FIG. 14A illustrates a front perspective view 1400*a* of carry case 1402, according to some embodiments. In the embodiment shown, the carry case 1402 is closed and a tab 1404 is shown at the top of the carry case 1402 above a closed flap 1414, which is employed as a carrying loop for the user. In some embodiments, the front side of the carry case 1402 is composed of a silicon fabric 1412 as shown for added grip for handling one or more inserts. The silicon fabric 1412 is a grippy silicon-beaded fabric that keeps a good grip for sliding the various inserts into the insert channel 508 during assembly and helps to avoid the insert from slipping and a user cutting themselves or their mittens.

FIG. 14B illustrates a front perspective view 1400*b* of carry case 1402 with a skate insert 1406 inserting into the interior of the carry case 1402, according to some embodiments. In the embodiment shown, the flap 1414 of the carry case 1402 is open, exposing the interior pouch that is employed to hold the various inserts for proper storage, easy traveling, and functional support. Two magnetic clasps 1408 are shown affixed to the exterior of the carry case 1402 and to the interior side of the flap 1414. The magnetic clasps 1408 are coupled for opening the flap 1414 and securing the flap 1414 closed. In some embodiments, the magnetic clasps 1408 are replaced by clips, snaps or any other locking mechanisms known in the art. In some embodiment, the interior pouch contains quick-drying material such as a nylon lining to keep the inside dry to prevent rusting the blade and that is also easy to wash.

FIG. 14C illustrates a back perspective view 1400*c* of carry case 1402, according to some embodiments. In the embodiment shown, the flap 1414 of the carry case 1402 is open and the tab 1404 is shown. In this embodiment, the back side of the carry case 1402 is composed of a microfiber cloth material 1410 as shown. The microfiber cloth material 1410 is a microfiber cloth material that is employed for clearing and drying ice and snow off of the blade to keep the blades dry after use.

The foregoing descriptions of specific embodiments of the present disclosure have been presented for purposes of illustration and description. They are not intended to be exhaustive or to limit the device or apparatus, and method of use, to the precise forms disclosed. Obviously, many modifications and variations are possible in light of the above teaching. As can be understood, the examples described above are intended to be exemplary only.

The embodiments described were chosen and described in order to best explain the principles of the disclosure and its practical application, and to thereby enable others skilled in the art to best utilize the various embodiments with various modifications as are suited to the particular use contemplated. It is understood that various omissions or substitutions of equivalents are contemplated as circumstance may suggest or render expedient but is intended to cover the application or implementation without departing from the spirit or scope of the claims of the present disclosure.

The term "connected", "attached", "affixed" or "coupled to" may include both direct coupling (in which two elements that are coupled to each other contact each other) and indirect coupling (in which at least one additional element is located between the two elements).

As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. An interchangeable boot attachment, for allowing seamless transition between a variety of boot modes that is assembled intuitively and performs in a secure manner, comprising:

a buckle strap affixed to a baseplate around a heel of said baseplate, said baseplate having an insert channel along a bottom of said baseplate that tapers from an opening at said heel towards a toe end of said baseplate and said buckle strap having a buckle that couples to a strap; and one or more inserts, said one or more inserts having a tapered projection that tapers in an identical formation to said insert channel and is coupled to said insert channel during assembly such that a dovetail joint is formed between said opening, said insert channel and said tapered projection, wherein said buckle is rotated and snapped into a locked position to apply tension along said strap to secure said one or more inserts to said insert channel, the strap is wrapped around said heel and covering said opening in said heel that provides access to said insert channel for said one or more inserts;

wherein said buckle is rotated and unsnapped into an engaged position to release said tension along said strap; and wherein said buckle is decoupled and removed from said strap in an open position to remove said strap from said opening to allow for removing said one or more inserts from said insert channel and inserting said one or more inserts into said insert channel.

2. The interchangeable boot attachment of claim 1, wherein said one or more inserts includes one or more of a gripped tread insert, a stability blade insert, a long-distance blade insert, an agility blade insert, a rollerblade insert, a roller skate insert, a ski insert, a snowshoe insert and a snowboard insert.

3. The interchangeable boot attachment of claim 1, wherein said interchangeable boot attachment is manufactured to a boot.

4. The interchangeable boot attachment of claim 1, wherein said baseplate is composed of a durable plastic material.

5. The interchangeable boot attachment of claim 1, wherein said interchangeable boot attachment is affixed to an existing boot.

6. The interchangeable boot attachment of claim 5, wherein said interchangeable boot attachment is affixed to said existing boot via a plurality of fasteners.

7. The interchangeable boot attachment of claim 5, wherein said interchangeable boot attachment is affixed to said existing boot via an adhesive.

8. The interchangeable boot attachment of claim 1, wherein said interchangeable boot attachment is accompanied by a carry case.

9. The interchangeable boot attachment of claim 8, wherein said carry case is composed of a silicon fabric on a front side for added grip for handling said one or more inserts, a microfiber cloth on a back side for clearing and drying ice and snow off of said one or more inserts and a quick-drying nylon lining within a pouch of said carry case to keep said pouch dry to prevent rusting said one or more inserts.

10. The interchangeable boot attachment of claim 1, wherein said one or more inserts comprise a cap at a back end which indicates a direction that said one or more inserts should be slid into said insert channel.

11. The interchangeable boot attachment of claim 10, wherein said cap is shaped in an identical formation to said opening such that said cap fills said opening providing more surface for said strap to contact and further secure said one or more inserts in place.

* * * * *